US009043009B2

(12) United States Patent
Kato et al.

(10) Patent No.: US 9,043,009 B2
(45) Date of Patent: May 26, 2015

(54) NON-TRANSITORY COMPUTER-READABLE MEDIUM AND DEVICE

(71) Applicant: BROTHER KOGYO KABUSHIKI KAISHA, Nagoya-shi, Aichi-ken (JP)

(72) Inventors: Aki Kato, Nagakute (JP); Kenji Yamada, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/261,042

(22) Filed: Apr. 24, 2014

(65) Prior Publication Data

US 2014/0318430 A1 Oct. 30, 2014

(30) Foreign Application Priority Data

Apr. 30, 2013 (JP) ..... 2013-094894

(51) Int. Cl.
*D05B 19/12* (2006.01)

(52) U.S. Cl.
CPC ..... *D05B 19/12* (2013.01)

(58) Field of Classification Search
CPC ..... D05B 19/02; D05B 19/12; D05B 19/08
USPC ..... 700/136–138; 112/102.5, 475.05, 112/475.18, 475.19
See application file for complete search history.

(56) References Cited

U.S. PATENT DOCUMENTS 6,629,015 B2 * 9/2003 Yamada ..... 700/138
6,980,877 B1 * 12/2005 Hagino et al. ..... 700/138
7,561,939 B2 * 7/2009 Kawabe et al. ..... 700/138
7,587,257 B2 * 9/2009 Niimi et al. ..... 700/138
7,693,598 B2 * 4/2010 Yamada ..... 700/138
7,946,235 B2 * 5/2011 Yamada ..... 112/470.01
7,996,103 B2 * 8/2011 Yamada ..... 700/138
8,200,357 B2 * 6/2012 Yamada ..... 700/138
8,271,123 B2 * 9/2012 Yamada ..... 700/138
8,335,584 B2 * 12/2012 Yamada ..... 700/138
8,340,804 B2 * 12/2012 Yamada et al. ..... 700/138
8,473,090 B2 * 6/2013 Yamada ..... 700/138
8,897,909 B2 * 11/2014 Yamada ..... 700/138
2002/0038162 A1 3/2002 Yamada
2010/0305744 A1 12/2010 Yamada
2014/0318430 A1 * 10/2014 Kato et al. ..... 112/102.5

FOREIGN PATENT DOCUMENTS

JP A-2001-259268 9/2001
JP A-2010-273859 12/2010

* cited by examiner

*Primary Examiner* — Danny Worrell
(74) *Attorney, Agent, or Firm* — Oliff PLC

(57) ABSTRACT

A non-transitory computer-readable medium storing computer-readable instructions that, when executed by a processor of a device, cause the device to acquire pieces of thread color data, acquire image data representing an image, arrange line segments based on the image data, calculate a ratio of a first area occupied by a specific object with respect to the image, identify one or more pieces of first thread color data based on the ratio, identify one or more pieces of second thread color data based on the image data, allocate, to one or more of first line segments corresponding to the first area, first specific thread color data among the first thread color data, allocate, to one or more of second line segments corresponding to the second area, second specific thread color data among the first thread color data and the second thread color data, connect the line segments, and create embroidery data.

19 Claims, 14 Drawing Sheets

NON-TRANSITORY COMPUTER-READABLE MEDIUM AND DEVICE

CROSS-REFERENCE TO RELATED APPLICATION

This application claims priority to Japanese Patent Application No. 2013-094894, filed Apr. 30, 2013, the content of which is hereby incorporated herein by reference in its entirety.

BACKGROUND

The present disclosure relates to a non-transitory computer-readable medium that stores computer-readable instructions that cause a device to create embroidery data for performing embroidery sewing by a sewing machine, as well as to a device that is capable of creating embroidery data, A device is known that is capable of creating embroidery data for embroidery sewing, by a sewing machine, of a design that is based on data for an image such as a photograph or the like. The device may create the embroidery data by the procedure described below, for example. First, based on the image data, the device may arrange line segments in a specified area. The device may determine a thread color that corresponds to each of the line segments, and connect the line segments that correspond to the same thread color. The device may create the embroidery data by converting data for the line segments into data that indicate stitches. The device may select a thread color that corresponds to a line segment from among a set of n thread colors. The number n is a number of thread colors that have been set as thread colors that will actually be used when an embroidery pattern is sewn.

SUMMARY

When an image, such as a photograph, is represented in the form of an embroidery design, a number n of thread colors that will actually be used may be around 10, in general. For example, the above-described device may reduce the colors of the original image to N colors. After that, the device may select, as thread colors to be used, the n thread colors that are each close to the N colors after color reduction, from thread colors that are available to a user. By mixing these n colors to represent other colors, it is possible to express the original image that includes more colors. However, even if a color can be represented by color mixing of a plurality of colors according to the calculation, the result may seem unnatural when it is expressed by stitches of embroidery threads. For example, it is difficult to say that the original image is naturally expressed when mixed color expression is performed using green color in a portion, such as a human face, which is supposed to be a skin color.

Various embodiments of the broad principles derived herein provide a non-transitory computer-readable medium storing computer-readable instructions that are capable of causing a device to select thread colors that are suitable for expressing an image that includes a specific object that is supposed to be represented by a specific color, and of creating embroidery data, as well as a device that is capable of creating the embroidery data.

Various embodiments herein provide a non-transitory computer-readable medium storing computer-readable instructions. When executed by a processor of a device, the computer-readable instructions cause the device to: acquire a plurality of pieces of thread color data, each of the plurality of pieces of thread color data representing a thread color, acquire image data representing an image; arrange a plurality of line segments based on the image data, each of the plurality of line segments corresponding to each of a plurality of stitches for sewing the image; calculate a ratio of a first area occupied by a specific object with respect to the image, based on the image data; identify one or more of pieces of first thread color data among the plurality of pieces of thread color data, based on the ratio; identify one or more of pieces of second thread color data among the plurality of pieces of thread color data, based on the image data; allocate, to one or more of first line segments corresponding to the first area, first specific thread color data among the one or more of pieces of first thread color data; allocate, to one or more of second line segments corresponding to a second area, second specific thread color data among the one or more pieces of first thread color data and the one or more pieces of second thread color data, wherein the second area is an area different from the first area in the image represented by the image data; connect the plurality of line segments based on the allocated thread color data; and create embroidery data representing the plurality of stitches based on the connected plurality of line segments.

Various embodiments also provide a device that includes a processor and a memory configured to store computer-readable instructions. When executed by the processor, the computer-readable instructions cause the device to acquire a plurality of pieces of thread color data, each of the plurality of pieces of thread color data representing a thread color; acquire image data representing an image; arrange a plurality of line segments based on the image data, each of the line segments corresponding to each of a plurality of stitches for sewing the image; calculate a ratio of a first area occupied by a specific object with respect to the image, based on the image data; identify one or more pieces of first thread color data among the plurality of pieces of thread color data, based on the ratio; identify one or more pieces of second thread color data among the plurality of pieces of thread color data, based on the image data; allocate, to one or more of first line segments corresponding to the first area, first specific thread color data among the one or more pieces of first thread color data; allocate, to one or more of second line segments corresponding to a second area, second specific thread color data among the one or more pieces of first thread color data and the one or more pieces of second thread color data, wherein the second area is an area different from the first area in the image represented by the image data; connect the plurality of line segments based on the allocated thread color data; and create embroidery data representing the plurality of stitches based on the connected plurality of line segments.

Various embodiments further provide a non-transitory computer-readable medium storing computer-readable instructions. When executed by a processor of a device, the computer-readable instructions cause the device to acquire a plurality of pieces of thread color data, each of the plurality of pieces of thread color data representing a thread color; acquire image data representing an image; arrange a plurality of line segments based on the image data, each of the plurality of line segments corresponding to each of a plurality of stitches for sewing the image; calculate a ratio of a first area occupied by a specific object with respect to the image, based on the image data; identify one or more pieces of first thread color data among the plurality of pieces of thread color data, based on the ratio, each of the one or more pieces of first thread color data representing a thread color within a first range from a reference color in a color space, and wherein the reference color is a representative color of the specific object; identify one or more pieces of second thread color data among the plurality of pieces of thread color data, based on the image data; allocate specific thread color data among the one or more pieces of second thread color data to each of the plurality of line segments, based on the image data; determine whether the one or more pieces of second thread color data include one or more pieces of third thread color data, each of the one or more pieces of third thread color data representing a thread color that is not within the first range and is within a second range from the reference color in the color space, wherein the second range is wider than the first range; replace each of the one or more pieces of third thread color data with one of the one or more pieces of first thread color data, in response to determining that the one or more pieces of second thread color data include the one or more pieces of third thread color data; connect the plurality of line segments based on the allocated thread color data; and create embroidery data representing the plurality of stitches based on the connected plurality of line segments.

BRIEF DESCRIPTION OF THE DRAWINGS

Embodiments will be described below in detail with reference to the accompanying drawings in which.

DETAILED DESCRIPTION

Figure 1:
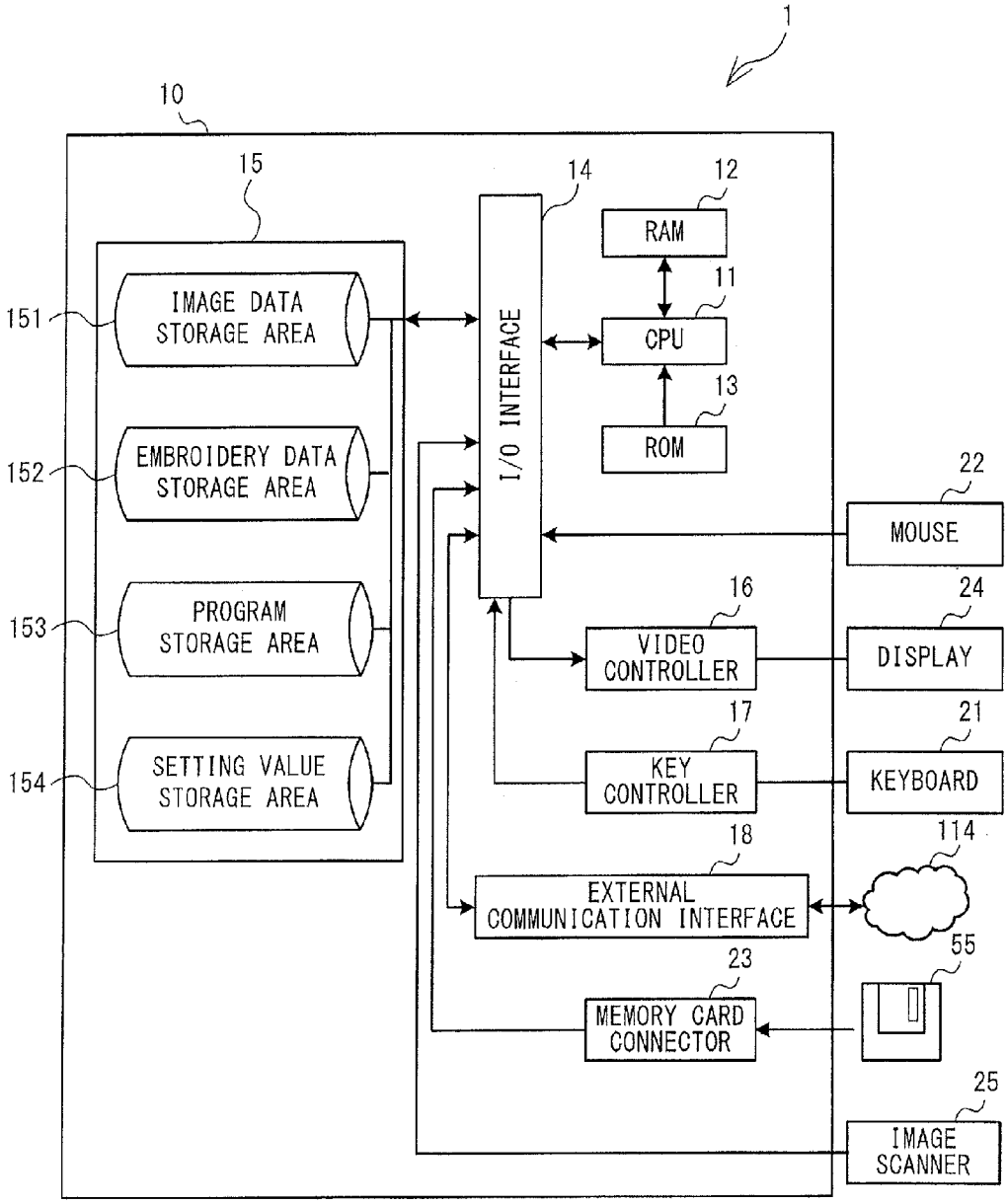
FIG. 1 is a block diagram showing an electrical configuration of an embroidery data creation device.

Hereinafter, embodiments will be explained with reference to FIG. 1 to FIG. 14. First, a configuration of an embroidery data creation device 1 will be explained with reference to FIG. 1, The embroidery data creation device 1 is a device that is configured to create embroidery data for use by a sewing machine 3 (refer to FIG. 2) that will be described later, for forming stitches of an embroidery pattern. The embroidery data creation device 1 of the present embodiment is capable of creating embroidery data for performing embroidery sewing of a design that is based on an image such as a photograph or the like.

The embroidery data creation device 1 may be a dedicated device that is only configured to create the embroidery data. The embroidery data creation device 1 may also be a general-purpose device such as a personal computer or the like. In the present embodiment, a general-purpose form of the embroidery data creation device 1 is explained as an example. As shown in FIG, 1, the embroidery data creation device 1 includes a CPU 11, which is a controller that is configured to perform control of the embroidery data creation device 1, A RAM 12, a ROM 13, and an input/output (I/O) interface 14 are connected to the CPU 11. The RAM 12 is configured to temporarily store various types of data, such as calculation results that are obtained in calculation processing by the CPU 11, and the like. The ROM 13 is configured to store a BIOS and the like.

The I/O interface 14 is configured to perform mediation of data transfers. A hard disk device (HDD) 15, a mouse 22, which is an input device, a video controller 16, a key controller 17, an external communication interface 18, a memory card connector 23, and an image scanner 25 are connected to the I/O interface 14.

A display 24, which is a display device, is connected to the video controller 16. A keyboard 21, which is an input device, is connected to the key controller 17. The external communication interface 18 is an interface that is configured to enable connection to a network 114. The embroidery data creation device 1 is capable of connecting to an external device through the network 114. A memory card 55 can be connected to the memory card connector 23. The embroidery data creation device 1 is configured to read data from the memory card 55 and write data to the memory card 55 through the memory card connector 23.

Storage areas in the HDD 15 will be explained. As shown in FIG. 1, the HDD 15 has a plurality of storage areas that include an image data storage area 151, an embroidery data storage area 152, a program storage area 153, and a setting value storage area 154. Image data for various types of images, such as images that may be used as the basis for the embroidery data creation, and the like, may be stored in the image data storage area 151. Embroidery data that are created by embroidery data creation processing in the present embodiment may be stored in the embroidery data storage area 152. Programs for various types of processing that may be performed by the embroidery data creation device 1, such as an embroidery data creation program that will be described later and the like, may be stored in the program storage area 153. Data on setting values that are to be used in the various types of processing may be stored in the setting value storage area 154.

The embroidery data creation program may be acquired from outside through the network 114 and stored in the program storage area 153. In a case where the embroidery data creation device 1 is provided with a DVD drive, the embroidery data creation program may be stored in a medium such as a DVD or the like and may be read and then stored in the program storage area 153.

Figure 2:
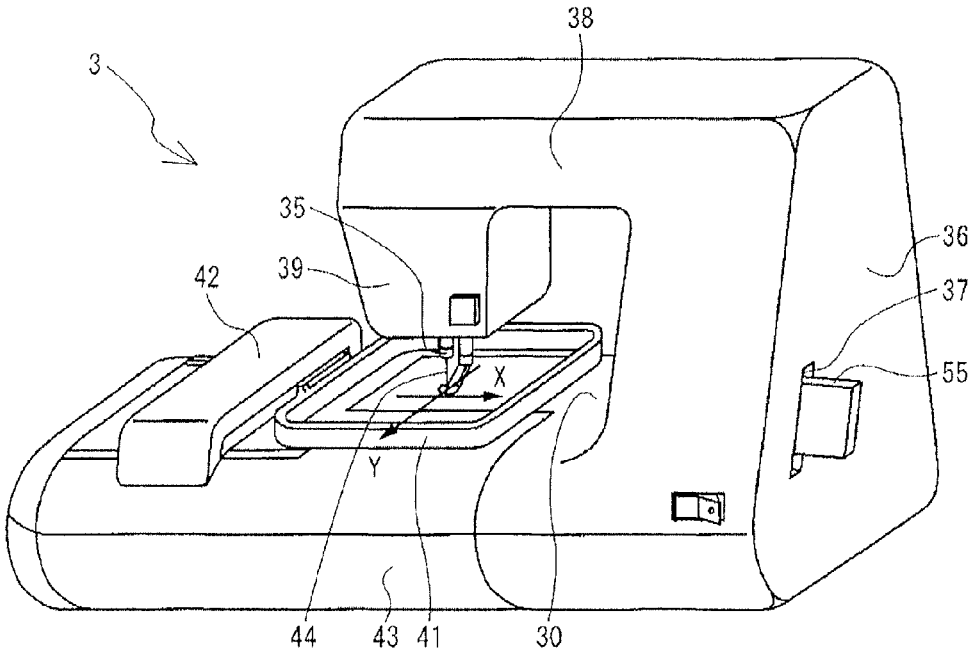
FIG. 2 is an outline view of a sewing machine.

The sewing machine 3, which is configured to sew an embroidery pattern based on the embroidery data, will be briefly explained with reference to FIG. 2. As shown in FIG. 2, the sewing machine 3 includes a bed 30, a pillar 36, and arm 38, and a head 39. The bed 30 is the base of the sewing machine 3 and is long in the left-right direction. The pillar 36 extends upward from the right end portion of the bed 30. The arm 38 extends to the left from the upper end of the pillar 36 such that the arm 38 is positioned opposite the bed 30. The head 39 is a portion that is joined to the left end of the arm 38.

When embroidery sewing is performed, a user of the sewing machine 3 may mount an embroidery frame 41 that holds a work cloth onto a carriage 42 that is disposed on the bed 30. The embroidery frame 41 may be moved by a Y direction moving mechanism (not shown in the drawings) that is contained in the carriage 42 and by an X direction moving mechanism (not shown in the drawings) that is contained in a main case 43 to a needle drop point that is indicated by an XY coordinate system that is unique to the sewing machine 3. In conjunction with the moving of the embroidery frame 41, a shuttle mechanism (not shown in the drawings) and a needle bar 35 to which a sewing needle 44 is attached may be operated, thereby forming an embroidery pattern on the work cloth. Note that the Y direction moving mechanism, the X direction moving mechanism, the needle bar 35, and the like may be controlled based on the embroidery data by a CPU (not shown in the drawings) that is built into the sewing machine 3. In the present embodiment, the embroidery data are data that indicate the coordinates of the needle drop points, the sewing order, and the colors of the embroidery threads to be used in order to form the stitches of the embroidery pattern.

A memory card slot 37 in which the memory card 55 can be removably inserted is provided on the right side face of the pillar 36 of the sewing machine 3. The embroidery data that have been created by the embroidery data creation device 1, for example, may be stored in the memory card 55 through the memory card connector 23. Then the memory card 55 may be inserted in the memory card slot 37 of the sewing machine 3, and the embroidery data that are stored in the memory card 55 may be read out and stored in the sewing machine 3. Based on the embroidery data that have been read from the memory card 55, the CPU of the sewing machine 3 may control the operation of the sewing of the embroidery pattern by the Y direction moving mechanism, the X direction moving mechanism, the needle bar 35, and the like. The sewing machine 3 is thus able to sew the embroidery pattern based on the embroidery data that have been created by the embroidery data creation device 1.

Hereinafter, the embroidery data creation processing that is performed by the embroidery data creation device 1 of the present embodiment will be explained with reference to FIG. 3 to FIG, 7. When the user inputs an instruction to start the processing, the CPU 11 starts the embroidery data creation processing. The CPU 11 reads the embroidery data creation program stored in the program storage area 153 of the HDD 15, and performs the following processing by executing instructions included in the program.

Figure 3:
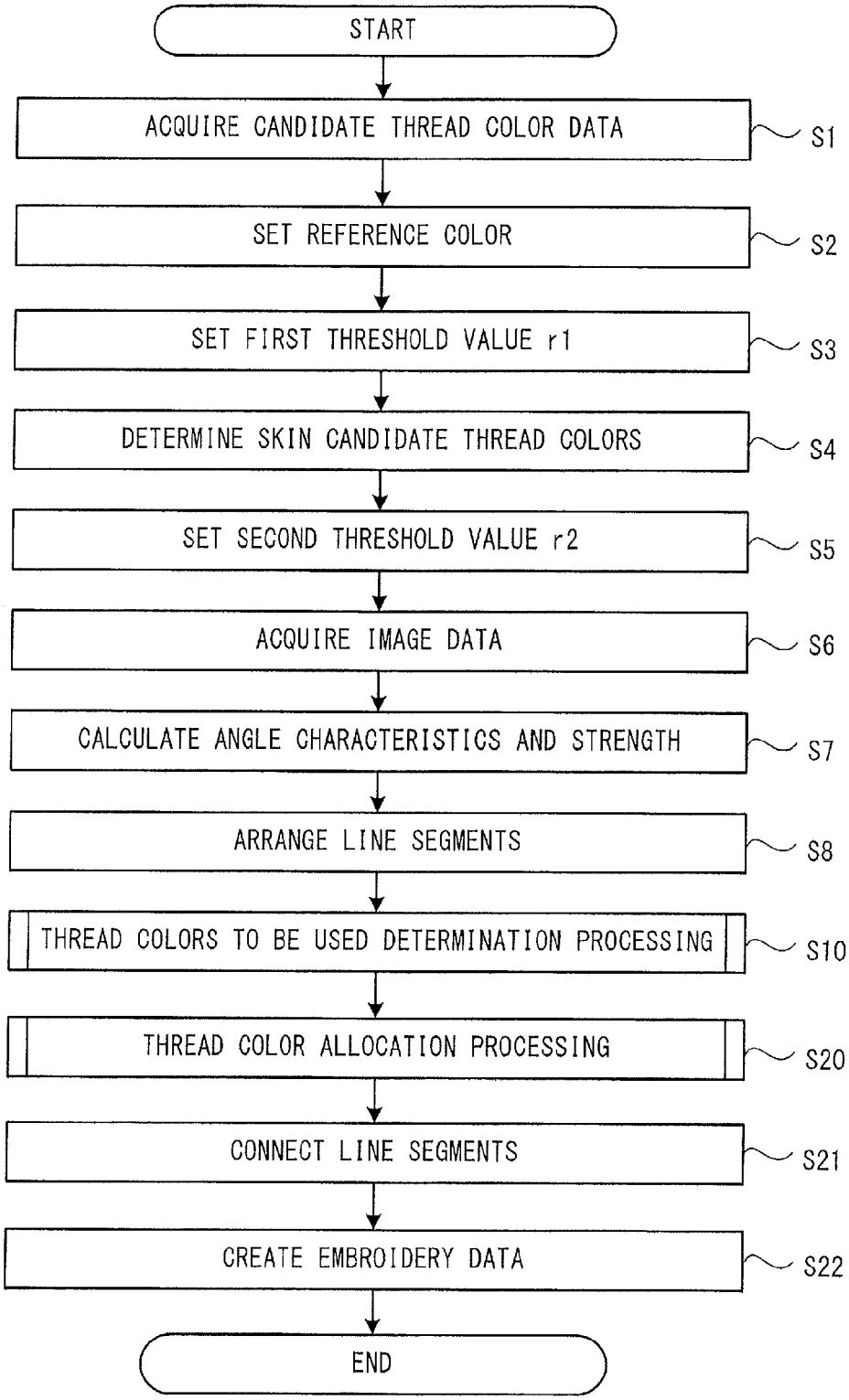
FIG. 3 is a flowchart of embroidery data creation processing.

As shown in FIG. 3, the CPU 11 first acquires candidate thread color data (step S1). The candidate thread color data includes data pieces that represent a plurality of candidate thread colors, respectively. The candidate thread colors are colors of a plurality of embroidery threads that can be used in the embroidery sewing. That is, the candidate thread colors are candidate colors of threads that are to be actually used in the embroidery sewing. In the present embodiment, the candidate thread color data at least includes data that represents the thread colors by RGB values. The candidate thread color data may be stored in advance in the setting value storage area 154 of the HDD 15, for example. The number of the candidate thread colors may be around several tens of colors, in general.

The CPU 11 sets a reference color from among the plurality of candidate thread colors (step S2). The CPU 11 next sets a first threshold value r1 (step S3). The reference color is a color of reference that is used to define a range of similar colors. The first threshold value r1 is a threshold value that indicates a distance from the reference color in color space and that defines a range of colors that are similar to the reference color.

In the present embodiment, the first threshold value r1 is used to set a range of specific thread colors that are used for sewing a specific object. For example, a skin color is regarded as a natural color for the skin portion of a human face. Therefore, when employing mixed expression using stitches of a plurality of embroidery threads having different colors, if a thread color such as green or light blue, for example, that is significantly different from the skin color is mixed in the skin portion, the result may appear unnatural. For that reason, in the present embodiment, when creating the embroidery data based on an image that includes a specific object that is supposed to be represented by a specific color, such as the skin portion of the human face, the CPU 11 performs processing to allocate a specific color to a stitch in the portion corresponding to the specific object. For this, the CPU 11 sets the reference color and the first threshold value r1 at step S2 and step S3.

In the present embodiment, the embroidery data creation processing will be exemplified by a case in which it is set in advance that the specific object is a human face (particularly the skin portion) and that the specific thread color is a skin color. For this reason, at step S2, the CPU 11 sets a reference skin color C, which is a representative skin color, as the reference color. The reference skin color C may be a skin color that is specified by the user via the keyboard 21 from among the plurality of candidate thread colors, or may be a skin color that is stored in advance in the setting value storage area 154 of the HDD 15. The CPU 11 stores the RGB values of the reference skin color C set at step S2 in the RAM 12. Further, the first threshold value r1 may be a value that is specified by the user, or may be a value that is stored in advance in the setting value storage area 154 of the HDD 15. The CPU 11 stores the value of the first threshold value r1 set at step S3 in the RAM 12.

Figure 4:
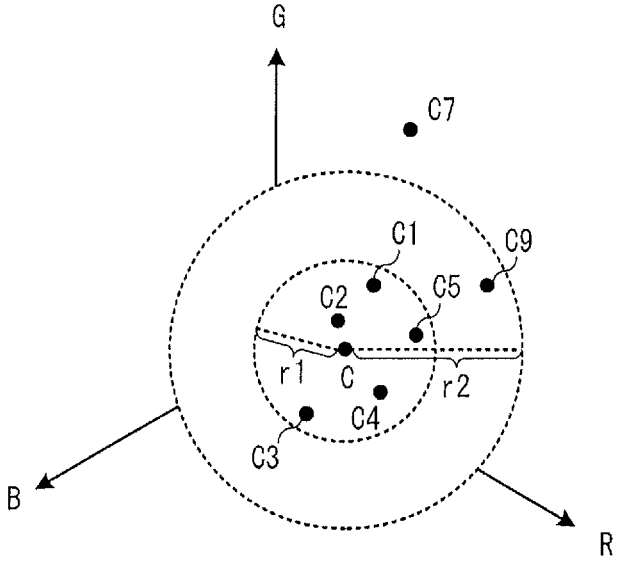
FIG. 4 is an explanatory diagram of relationships between a reference skin color, a first threshold value, and a second threshold value.

Based on the set reference skin color C and first threshold value r1, from among the plurality of candidate thread colors, the CPU 11 determines, as skin candidate thread colors, thread colors for which a distance to the reference skin color C is smaller than the first threshold value r1 in RGB space (step S4). As shown in FIG. 4, the skin candidate thread colors are thread colors that are within a sphere centering on the reference skin color C and having a radius r1 in RGB space (thread colors C1 to C5 in the example shown in FIG. 4). By thus setting the thread colors that are within a specific range from the reference skin color C as the skin candidate thread colors, the CPU 11 can efficiently specify, by calculation, colors that are close to the reference skin color C. The number of skin candidate thread colors is not particularly limited. The CPU 11 stores the RGB values of the determined skin candidate thread colors in the RAM 12. Note that, when the RGB values of a first color are defined as (R1, G1, B1) and the RGB values of a second color that is different to the first color are defined as (R2, G2, B2), a distance d between the first color and the second color in RGB space can be calculated using the following formula.

$$d=\sqrt{\{(R1-R2)^2+(G1-G2)^2+(B1-B2)^2\}}$$

The CPU 11 further sets a second threshold value r2 (step S5). The second threshold value r2 is a threshold value that indicates a distance from the reference color (the reference skin color C in the present embodiment) in color space, and that defines a range in which a specific thread color (the skin color in the present embodiment) is preferentially allocated. The second threshold value r2 may also be a value that is specified by the user, or may be a value that is stored in advance in the setting value storage area 154 of the HDD 15. Note, however, that the second threshold value r2 is a value that is larger than the first threshold value r1. As shown in FIG. 4, the range that is defined by the second threshold value r2 corresponds to an area within a sphere centering on the reference skin color C and having a radius r2 in RGB space. In other words, the colors inside the range of the second threshold value r2 are colors that are close to the reference skin color C, to a certain degree. The CPU 11 stores the value of the second threshold value r2 set at step S5 in the RAM 12, The CPU 11 acquires, into the RAM 12, image data of an image (hereinafter referred to as an original image) that is used as a basis for creating the embroidery data (step S6), A method for acquiring the image data is not particularly limited. For example, the image, such as a photo or a design, may be read by the image scanner 25 and the acquired image data may be used. Alternatively, the CPU 11 may acquire the image data that is stored in advance in the image data storage area 151 of the HDD 15. The CPU 11 may acquire the image data from the outside via the network 114. The CPU 11 may acquire the image data that is stored in a medium, such as the memory card 55. In the present embodiment, the CPU 11 acquires the image data that represents the colors of the individual pixels by RGB values.

Based on the acquired image data, the CPU 11 calculates angle characteristics and an strength of the angle characteristics for each of the plurality of pixels that form the original image (step S7). The angle characteristics are information indicating a direction in which color continuity in the image is high. In other words, the angle characteristics are information indicating a direction (angle) in which the color of a certain pixel is most continuous when the color of the certain pixel is compared with colors of surrounding pixels. The strength of the angle characteristics is information indicating the magnitude of color change.

The CPU 11 may use any method to calculate the angle characteristics and the strength of the angle characteristics. The CPU 11 may calculate the angle characteristics and the strength of the angle characteristics, for example, using a method disclosed in Japanese Laid-Open Patent Publication No. 2001-259268 (US Patent Application Publication No. 2002/0038162), relevant portions of which are incorporated herein by reference. The method is briefly explained below. The CPU 11 first sets, as a target pixel, one of the pixels that make up the original image, and sets, as a target area, the target pixel and a specified number (eight, for example) of the pixels that surround the target pixel. Based on the attribute values (for example, the brightness values) that pertain to the colors of the individual pixels within the target area, the CPU 11 specifies a direction in which the continuity of the color in the target area is high, and sets the direction as the angle characteristic of the target pixel. Further, the CPU 11 calculates a value that indicates the magnitude of the change in the color in the target area, and sets the value as the strength of the angle characteristic for the target pixel, The CPU 11 may calculate the angle characteristics and the strength of the angle characteristics using a Prewitt operator or a Sobel operator, for example, instead of the method described above.

Based on the angle characteristics and the strength of the angle characteristics that have been calculated, the CPU 11 performs processing to arrange a plurality of line segments in an area that corresponds to the original image (step S8). Each of the line segments corresponds to a stitch in the embroidery pattern, and has two end points that correspond to needle drop points. The line segments arranged at step S8 may have a certain length corresponding to a value input from the keyboard 21 by the user or a value that is set in advance and stored in the setting value storage area 154 of the HDD 15. The CPU 11 stores data that identifies the arranged line segments (hereinafter referred to as line segment data) in the RAM 12. The line segment data may be, for example, coordinate data pieces of the X-Y coordinate system indicating positions of the end points of all the line segments arranged in the area that corresponds to the original image.

The CPU 11 may use any method to arrange the line segments based on the angle characteristics and the strength of the angle characteristics. For example, the CPU 11 may arrange the line segments using the method disclosed in Japanese Laid-Open Patent Publication No. 2001-259268 (US Patent Application Publication No. 2002/0038162), relevant portions of which are incorporated herein by reference. The method is briefly explained below. The CPU 11 arranges line segments, giving priority to line segments each centered at a position that corresponds to a pixel for which the strength of the angle characteristics is not less than a specified threshold value. The CPU 11 then arranges line segments each centered at a position that corresponds to a pixel for which the strength of the angle characteristics is less than the specified threshold value, taking into account overlapping of the line segment with other line segments that have already been arranged, as well as the angle characteristics of the surrounding pixels.

Figure 5:
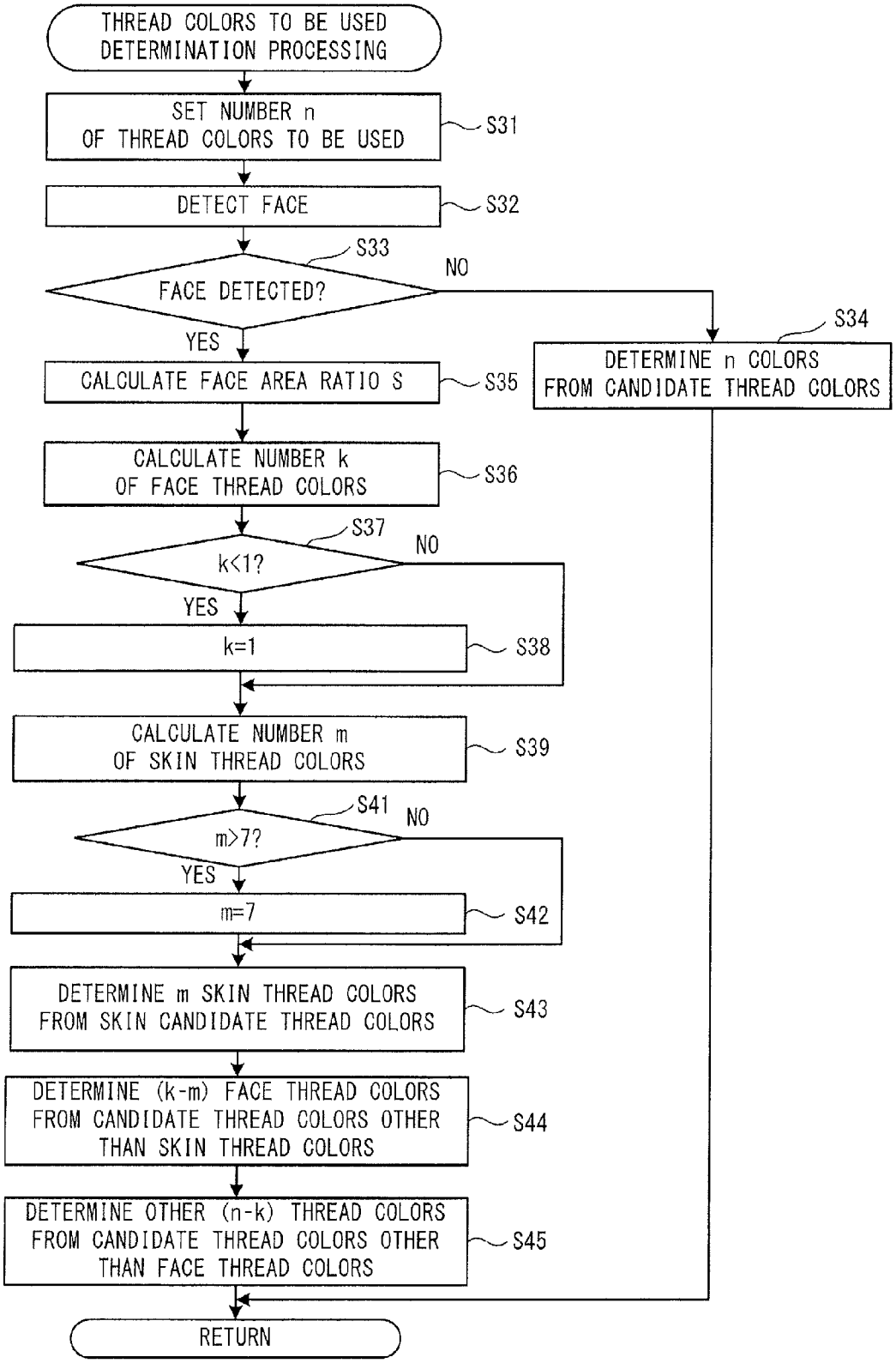
FIG. 5 is a flowchart of thread colors to be used determination processing.

The CPU 11 performs thread colors to be used determination processing (step S10 and FIG. 5). The thread colors to be used determination processing is processing to determine, from among the plurality of candidate thread colors, the colors of the threads that will actually be used in the embroidery sewing. Hereinafter, the colors of the threads that will actually be used in the embroidery sewing are referred to as thread colors to be used. As shown in FIG. 5, in the thread colors to be used determination processing, the CPU 11 first sets a number n of thread colors to be used, which is a number of the thread colors to be used (step S31). The number n of thread colors to be used may be a value that is specified by the user or may be a value that is stored in advance in the setting value storage area 154 of the HDD 15. Generally, the number n of thread colors to be used may be approximately 10.

Based on the image data of the original image acquired at step S6, the CPU 11 performs processing to detect a human face in the original image (step S32). The CPU 11 may use any method to detect the face in the image. For example, the CPU 11 may detect a face section (hereinafter referred to as a face area) in the image in accordance with discriminant criteria. The discriminant criteria may be created, for example, using statistical machine learning of local feature quantities obtained in advance from a large number of learning samples. Various methods are known as the detection method and a detailed explanation thereof is thus omitted here. The local feature quantities that can be adopted include Haar-like features, Histograms of Oriented Gradient (HOG) features etc. Further, statistical learning methods that can be adopted include AdaBoost, neural networking etc.

Figure 6:
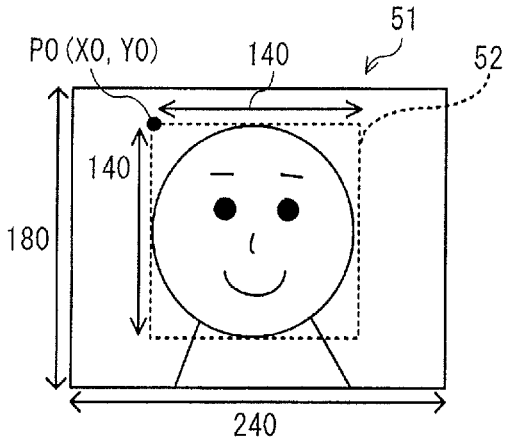
FIG. 6 is a diagram showing an example of an original image.

In a case where the CPU 11 detects a human face in the original image at step S32, the CPU 11 stores data representing a position of the face area in the original image in the RAM 12. For example, in a case where the CPU 11 detects a rectangular face area 52 from an original image 51, as shown in FIG. 6, the CPU 11 may store, as the data representing the position of the face area 52, coordinates (X0, Y0) indicating a top left vertex PO of the face area 52, the number (140) of pixels in the vertical direction and the number (140) of pixels in the horizontal direction.

In a case where the CPU 11 does not detect a human face (no at step S33), the CPU 11 determines n thread colors as the thread colors to be used, from among the candidate thread colors (step S34). In this case, the CPU 11 may use any method to determine the n thread colors to be used. For example, the user may specify a desired number n of thread colors from the candidate thread colors, as disclosed in Japanese Laid-Open Patent Publication No. 2001-259268 (US Patent Application Publication No. 2002/0038162), relevant portions of which are incorporated herein by reference. Further, the CPU 11 may reduce the number of colors in the original image to the number n, using a median cut method etc., and, from among the candidate thread colors, may determine n thread colors to be used that are respectively closest to the n colors after color reduction, as disclosed in Japanese Laid-Open Patent Publication No. 2010-273859 (US Patent Application Publication No. 2010/0305744).

In a case where the CPU 11 detects a human face in the original image (yes at step S33), the CPU 11 calculates a face area ratio S (step S35). The face area ratio S is ratio of the face area with respect to the original image. In the example shown in FIG. 6, the number of pixels of the original image 51 is 43,200 (=180×240) and the number of pixels of the face area 52 is 19,600 (=140×140). Thus, the face area ratio S is 45.4%.

Depending on the face area ratio S, the CPU 11 calculates a number k of face thread colors from among the number n of thread colors to be used (step S36). The number k of face thread colors is the number of face thread colors. The face thread colors are thread colors that correspond to the face area. For example, the CPU 11 may set, as the number k of face thread colors, a value that is obtained by multiplying the number n of thread colors to be used by the face area ratio S. In a case where the obtained value is not an integer, the CPU 11 may round the value to the nearest integer. Thus, the larger the face area ratio S, the greater the number k of face thread colors becomes. In a case where the original image 51 shown in FIG. 6 is used and the number n of thread colors to be used is set to 10, the number k of face thread colors is 5 (a value obtained when 4.54 is rounded). The CPU 11 stores the value of the number k of face thread colors calculated at step S36 in the RAM 12.

In a case where the number k of face thread colors calculated at step S36 is not less than 1 (no at step S37), the CPU 11 advances directly to the processing at step S39. In a case where the number k of face thread colors calculated at step S36 is less than 1, namely, in a case where it is 0 (yes at step S37), the CPU 11 updates the number k of face thread colors stored in the RAM 12 to 1 (step S38), and advances to the processing at step S39. The CPU 11 calculates a number m of skin thread colors based on the number k of face thread colors (step S39). The number m of skin thread colors is a number of skin thread colors. The skin thread colors are thread colors that are preferentially used for sewing the skin portion of the human face. The CPU 11 stores the value of the number m of skin thread colors calculated at step S39 in the RAM 12.

In the present embodiment, the CPU 11 sets, as the number m of skin thread colors, a value that is obtained by multiplying the number k of face thread colors by 0.5. In a case where the obtained value is not an integer, the CPU 11 may round the value to the nearest integer. In the above-described example, the number m of skin thread colors is 3 (a value obtained when 2.5 is rounded). In the present embodiment, the reason that 0.5 is adopted as the factor for multiplying the number k of face thread colors is based on the following idea. The idea is that as the human face includes colors that are different to the skin, such as eyes, mouth and eyebrows, half of the face thread colors may be allocated to the skin, and the remaining half may be allocated to sections that are different to the skin. However, the factor is not necessarily limited to the above example. For example, it is also possible to use the factor that becomes gradually smaller as the number k of face thread colors becomes larger. Alternatively, a factor that is specified by the user may be used.

Note that, in the processing at step S37 and step S38, the CPU 11 always sets a value that is equal to or more than 1 as the number k of face thread colors. As a result, by the processing at step S39, the number m of skin thread colors is always equal to or more than 1. Such processing is performed in order to avoid a case in which no skin color is determined as the thread color to be used, even if the face area with respect to the original image is extremely small, as long as a human face is detected in the original image.

In a case where the number m of skin thread colors is not greater than 7 (no at step S41), the CPU 11 advances directly to the processing at step S43. In a case where the number m of skin thread colors is greater than 7 (yes at step S41), the CPU 11 updates the number m of skin thread colors stored in the RAM 12 to an upper limit value of 7 (step S42). This is based on the following idea. For example, when the number n of thread colors to be used is set to 50, and the face area ratio S is 80%, the number m of skin thread colors calculated at step S39 is 20. However, it is possible to express a natural skin color without using 20 colors. Therefore, it may be better to add a color that is not similar to the skin color to the thread colors to be used. Note that the upper limit value of 7 is an example, and another value may be set. Further, the upper limit value may vary depending on the number n of thread colors to be used, or may be specified by the user. Alternatively, the upper limit value need not necessarily be set.

The CPU 11 determines the m skin thread colors from among the skin candidate thread colors determined at step S4 (refer to FIG. 3). The CPU 11 stores the RGB values of each of the determined skin thread colors in the RAM 12. In the present embodiment, the CPU 11 selects the m colors based on a distance in RGB space between the reference skin color C and each of the skin candidate thread colors. However, the CPU 11 may adopt m colors specified by the user, or may select m colors at random from the skin candidate thread colors.

As shown in FIG. 4, in a case where the five thread colors C1 to C5 of the skin candidate thread colors are determined and the number m of skin thread colors is determined as 3, the CPU 11 may determine the skin thread colors in the following manner, for example. First, the CPU 11 selects the thread color C2, which is closest in distance to the reference skin color C in RGB space. Of the remaining four colors, the CPU 11 selects, as a second color, the thread color C3, which is furthest in distance from the thread color C2. Further, the CPU 11 selects, as a third color, the thread color C5 which is furthest in distance from the thread colors C2 and C3. By selecting the color that is the furthest possible from the already selected colors in this way, it is possible to express colors over a wider range than in a case in which a plurality of mutually similar colors are selected.

From among the candidate thread colors other than the already determined skin thread colors, the CPU 11 determines the remaining face thread colors (step S44). As the skin thread colors are a part of the face thread colors, the number of the remaining face thread colors is a number (k−m) obtained by subtracting the number m of skin thread colors from the number k of face thread colors. For example, the CPU 11 may determine the remaining face thread colors using the following method. The CPU 11 first reduces the colors of the original image to n colors using a median cut method or the like. From among the candidate thread colors other than the skin thread colors, the CPU 11 may select, as the (k−m) colors, colors that are within a predetermined distance in RGB space from colors of pixels within the face area after the color reduction and that are as far as possible from the already determined thread colors. The CPU 11 stores the RGB values of each of the determined face thread colors in the RAM 12.

From among the candidate thread colors other than the already determined face thread colors, the CPU 11 determines the remaining thread colors to be used (step S45). The number of remaining thread colors to be used is a number (n−k) obtained by subtracting the number k of face thread colors from the number n of thread colors to be used. In a similar manner to step S44, for example, the CPU 11 may select, as the (n−k) colors, colors that are as far as possible from the already determined thread colors, based on colors of pixels of sections of the original image other than the face area after the color reduction. The CPU 11 stores the RGB values of each of the determined remaining thread colors to be used in the RAM 12. When the CPU 11 completes the determination of all of the thread colors to be used at step S45, the CPU 11 ends the thread colors to be used determination processing and returns to the embroidery data creation processing shown in FIG. 3.

Figure 7:
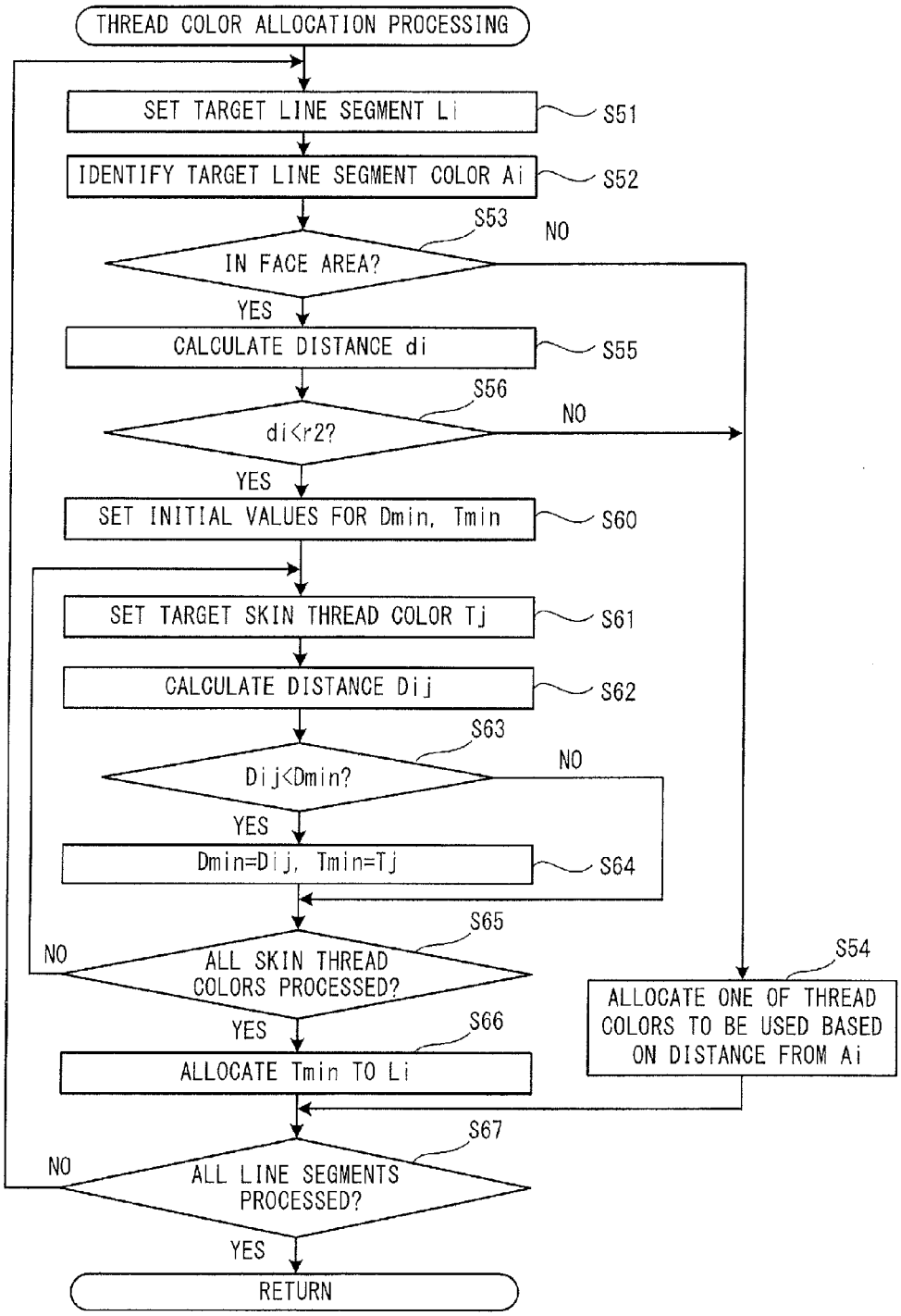
FIG. 7 is a flowchart of thread color allocation processing.

As shown in FIG. 3, after the thread colors to be used determination processing (step S10), the CPU 11 performs thread color allocation processing (step S20 and FIG. 7). The thread color allocation processing is processing to allocate one of the thread colors to be used to each of the line segments arranged at step S8. As shown in FIG. 7, in the thread color allocation processing, the CPU 11 first sets, as a target line segment Li that is a target of processing, an unprocessed line segment from among all of the line segments arranged in the area corresponding to the original image (step S51). For example, from among all of the line segments, the CPU 11 may set, as the target line segment Li, a line segment having an end point whose X coordinate and Y coordinate are respectively closest to zero.

The CPU 11 identifies a target line segment color Ai that is a color of the target line segment Li (step S52). In a case where the CPU 11 arranges, in the processing at step S8, the line segment having the certain length such that the center of the line segment is in a position corresponding to a specific pixel, the CPU 11 may use, as the target line segment color Ai, the color (RGB values) of the pixel (hereinafter referred to as a central pixel) corresponding to the center of the target line segment Li in the original image. Alternatively, an average value of the RGB values of a plurality of pixels that are in positions corresponding to the target line segment Li in the original image may be used.

In addition, the CPU 11 may calculate the target line segment color Ai using the method disclosed in Japanese Laid-Open Patent Publication No. 2001-259268 (US Patent Application Publication No. 2002/0038162), relevant portions of which are incorporated herein by reference. The method is briefly explained below. The CPU 11 first sets, in the original image, a specified range that has a specific pixel at its center as a range (a reference area) in which the colors of the original image are referenced. The CPU 11 determines the color of the line segment that corresponds to the specific pixel such that the average value of the colors that have already been determined for the line segments arranged in a corresponding area is equal to the average value of the colors within the reference area in the original image. The corresponding area is an area that has the same size as the reference area and that has the specific pixel at its center. According to this method, the CPU 11 determines the target line segment color Ai based on the colors of the original image and the colors of the line segments that have already been determined.

The CPU 11 determines whether or not the target line segment Li is in the face area (step S53). For example, the CPU 11 may perform the determination based on whether the central pixel of the target line segment Li is in the face area, based on the data stored in the RAM 12 that represents the position of the face area in the original image and the line segment data piece of the target line segment Li. In a case where the target line segment Li is not in the face area (no at step S53), it is not necessary to specially allocate one of the skin thread colors to the target line segment Li. Therefore, the CPU 11 allocates one of the n thread colors to be used determined at step S10 (refer to FIG, 3 and FIG. 5) to the target line segment Li, as the thread color to be used, which is used to sew the stitch corresponding to the target line segment Li (step S54). For example, from among the n thread colors to be used, the CPU 11 may allocate, to the target line segment Li, the thread color closest in distance in RGB space to the target line segment color Ai identified at step S52. The CPU 11 associates data representing the allocated thread color to be used with the line segment data piece of the target line segment Li and stores the associated data in the RAM 12.

In a case where the target line segment Li is in the face area (yes at step S53), the CPU 11 calculates a distance di in RGB space between the reference skin color C and the target line segment color Ai (step S55). The CPU 11 determines whether or not the distance di is smaller than the second threshold value r2 (step S56). As described above, the second threshold value r2 defines the range of colors that are close to the reference skin color C to a certain degree, and also defines the range in which the skin thread color is preferentially allocated. In a case where the distance di is not smaller than the second threshold value r2 (no at step S56), that is, in a case where the target line segment color Ai is not within the sphere centering on the reference skin color C and having the radius r2, as shown by the thread color C7 in FIG. 4, the target line segment color Ai is not particularly similar to the reference skin color C. Therefore, it is not necessary to specially allocate one of the skin thread colors to the target line segment Li. Therefore, as described above, the CPU 11 allocates one of the n thread colors to be used to the target line segment Li (step S54).

After the processing at step S54, the CPU 11 determines whether or not the thread color to be used has been allocated to all of the line segments (step S65). In a case where the line segment is remaining to which the thread color to be used has not been allocated (no at step S65), the CPU 11 returns to the processing at step S51 and re-sets another unprocessed line segment as the target line segment Li.

In a case where the distance di between the reference skin color C and the target line segment color Ai is smaller than the second threshold value r2 (yes at step S56), that is, in a case where the target line segment color Ai is within the sphere centering on the of the reference skin color C and having the radius r2, as shown by the thread color C9 in FIG. 4, the target line segment color Ai is similar to the reference skin color C to a certain degree. In this case, the target line segment Li can be regarded as a line segment that corresponds to the skin portion of the face area. Thus, the CPU 11 performs processing to allocate, to the target line segment Li, the color that is closest to the target line segment color Ai from among the m skin thread colors determined at step S43 (refer to FIG. 5) (step S60 to step S65).

First, the CPU 11 sets initial values, which indicate "not set," to each of a value Dmin and a value Tmin and stores the initial values in the RAM 12 (step S60). The value Dmin is a value that is used to identify a minimum value of respective distances in RGB space between the target line segment color Ai and the m skin thread colors. The value Tmin is a value that is used to identify the skin thread color for which the distance to the target line segment color Ai is the minimum value Dmin. The CPU 11 sets one unprocessed color from among the m skin thread colors as a target skin thread color Tj (step S61).

The CPU 11 calculates a distance Dij between the target skin thread color Tj and the target line segment color Ai (step S62). The CPU 11 determines whether or not the distance Dij is smaller than the value Dmin (step S63). In a case where the value Dmin is the initial value, the CPU 11 determines that the distance Dij is smaller than the value Dmin (yes at step S63). In this case, the CPU 11 updates the value Dmin with a value of the distance Dij and updates the value Tmin with a value indicating the target skin thread color Tj (step S64). In a case where the processing of all of the m skin thread colors is not complete (no at step S65), the CPU 11 returns to the processing at step S61 and re-sets one unprocessed skin thread color as the target skin thread color Tj.

In a case where the distance Dij between the target skin thread color Tj and the target line segment color Ai is smaller than the value Dmin (yes at step S63), the target skin thread color Tj is closer to the target line segment color Ai than the previously processed skin thread color. Therefore, the CPU 11 updates the value Dmin with the value of the distance Dij, and updates the value Tmin with the value indicating the target skin thread color Tj (step S64). In a case where the distance Dij is not smaller than the value Dmin (no at step S63), the target skin thread color Tj is a color that is further from the target line segment color Ai than the previously processed skin thread color, or is a color that is similar to the same degree. Therefore, the CPU 11 advances directly to the processing at step S65 without updating the value Dmin and the value Tmin.

In a case where the processing of all of the m skin thread colors is not complete (no at step S65), the CPU 11 repeats the processing from step S61 to step S65. When the processing of all of the m skin thread colors is complete (yes at step S65), the CPU 11 allocates the skin thread color identified by the value Tmin, namely, the skin thread color that is closest to the target line segment color Ai, as the thread color to be used corresponding to the target line segment Li (step S66).

In the example shown in FIG. 4, when the target line segment color Ai is the color C9 and processing is performed with the three skin thread colors C2, C3 and C5 taken as the target skin thread color Tj, in that order, in the first round of processing, a value indicating the thread color C2 is set as the value Tmin. In the second round of processing, as the distance between the color C9 and the thread color C3 is longer than the distance between the color C9 and the thread color C2, the CPU 11 does not update the value Tmin. In the third round of processing, as the distance between the color C9 and the thread color C5 is shorter than the distance between the color C9 and the thread color C2, the CPU 11 updates the value Tmin to a value indicating the thread color C5 and the processing of all the skin thread colors is complete. In this manner, the thread color C5, which is closest to the color C9 among the thread colors C2, C3 and C5, is allocated to the target line segment Li of the color C9.

While the line segments are remaining for which the processing to allocate the thread colors to be used is not complete (no at step S67), the CPU 11 repeats the processing to newly set the target line segment Li and to allocate, to the target line segment Li, one of the skin thread colors in a case where the target line segment Li is in the face area, or one of the thread colors to be used in a case where the target line segment Li is not in the face area (step S51 to step S67). When the processing to allocate the thread colors to be used is complete for all of the line segments (yes at step S67), the CPU 11 ends the thread color allocation processing and returns to the embroidery data creation processing shown in FIG. 3.

As shown in FIG. 3, after the thread color allocation processing (step S20), the CPU 11 performs processing to connect the line segments (step S21). More specifically, among the plurality of line segments, the CPU 11 connects, in order, the line segments to which the same thread color to be used has been allocated, and creates the line segment data for each of the thread colors to be used. For example, the CPU 11 may take two end points of a line segment as a starting point and an ending point, respectively, and may set, as a starting point of a next stitch, an end point of another line segment of the same color that is in a position closest to the ending point of a first line segment. By repeating this processing, the CPU 11 may connect the line segments. Based on the line segment data of each of the thread colors to be used created at step S21, the CPU 11 creates the embroidery data (step S22). The CPU 11 calculates the coordinates of needle drop points by converting the coordinates of the end points of each of the line segments into coordinates of the XY coordinate system that is unique to the sewing machine 3. Further, the CPU 11 sets an order of connecting the line segments as a sewing order of the needle drop points. In this manner, after creating the embroidery data that represents the coordinates of the needle drop points, the sewing order and the thread colors to be used, the CPU 11 ends the embroidery data creation processing shown in FIG. 3.

As explained above, in the present embodiment, in a case where the original image includes a human face, the CPU 11 determines one or more skin thread colors that will be used for sewing the skin portion of the human face, depending on the ratio of the face area with respect to the original image. Then, the CPU 11 preferentially allocates one of the one or more skin colors to each of the line segments that are arranged in the skin portion, among the line segments that are arranged in the area corresponding to the image. In this manner, when sewing the skin portion of the human face, it is possible to inhibit a thread color other than the skin thread color from being used. As a result, according to the embroidery data creation processing of the present embodiment, it is possible to create the embroidery data by selecting the thread colors that are suitable for expressing the image that includes the human face that is supposed to be represented by the skin color.

Hereinafter, embroidery data creation processing according to another embodiment will be explained with reference to FIG. 8 to FIG, 10. The embroidery data creation processing explained below is partly identical to the embroidery data creation processing of the above-described embodiment (refer to FIG. 3). Thus, in FIG. 8, the same reference numerals are assigned to the steps that have the same processing content as the processing shown in FIG. 3. Further, in the following explanation, content of the processing that is different to the above-described embodiment is mainly explained.

Figure 8:
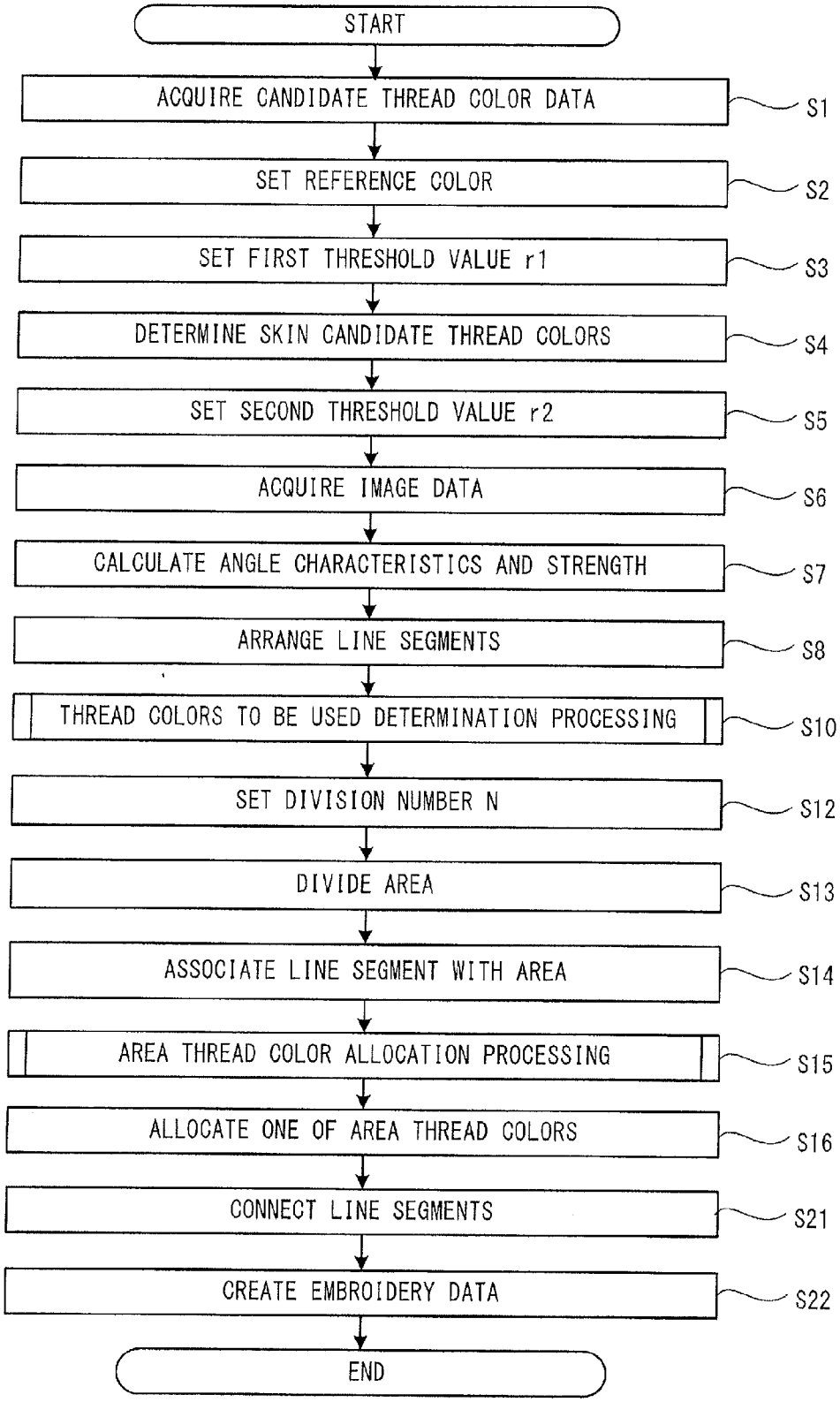
FIG. 8 is a flowchart of embroidery data creation processing of another embodiment.

As shown in FIG. 8, the processing at step S1 to step S10 in which the line segments are arranged based on the image data of the original image and the thread colors to be used are determined is the same as the processing of the above-described embodiment, and an explanation thereof is the same as that made in reference to FIG. 3. After that, the CPU 11 divides the original image into a plurality of areas based on the colors of the original image, and performs processing to associate each of a plurality of line segments with one of the plurality of areas after the original image is divided up (step S12 to step S14). In the present embodiment, as the processing from step S12 to step S14, processing is adopted that is disclosed as processing at step S50 to step S70 of main processing in Japanese Laid-Open Patent Publication No. 2010-

273859 (US Patent Application Publication No. 2010/0305744), relevant portions of which are incorporated herein by reference.

To briefly explain, the CPU 11 first sets a division number N that indicates how many areas the original image is divided into based on the colors of the original image (step S12). The division number N may be a value that is set in advance or is a value that is specified by the user. The division number N need not necessarily be the same as the number n of thread colors to be used. It is preferable, however, that these values are approximately the same. Based on the image data of the original image, the CPU 11 reduces the colors to N representative colors of the original image using a median cut method, for example, and thus divides the original image into N areas (step S13). A cluster of pixels having the same representative color after color reduction is taken as one area.

The CPU 11 associates each of the line segments arranged at step S8 with one of the N areas (step S14). For example, the CPU 11 may associate each of the line segments with an area including the central pixel of the line segment. For each of the N areas, the CPU 11 associates data representing the position in the original image, data representing the representative color and line segment data pieces of the area, and stores the associated pieces of data in the RAM 12.

Figure 9:
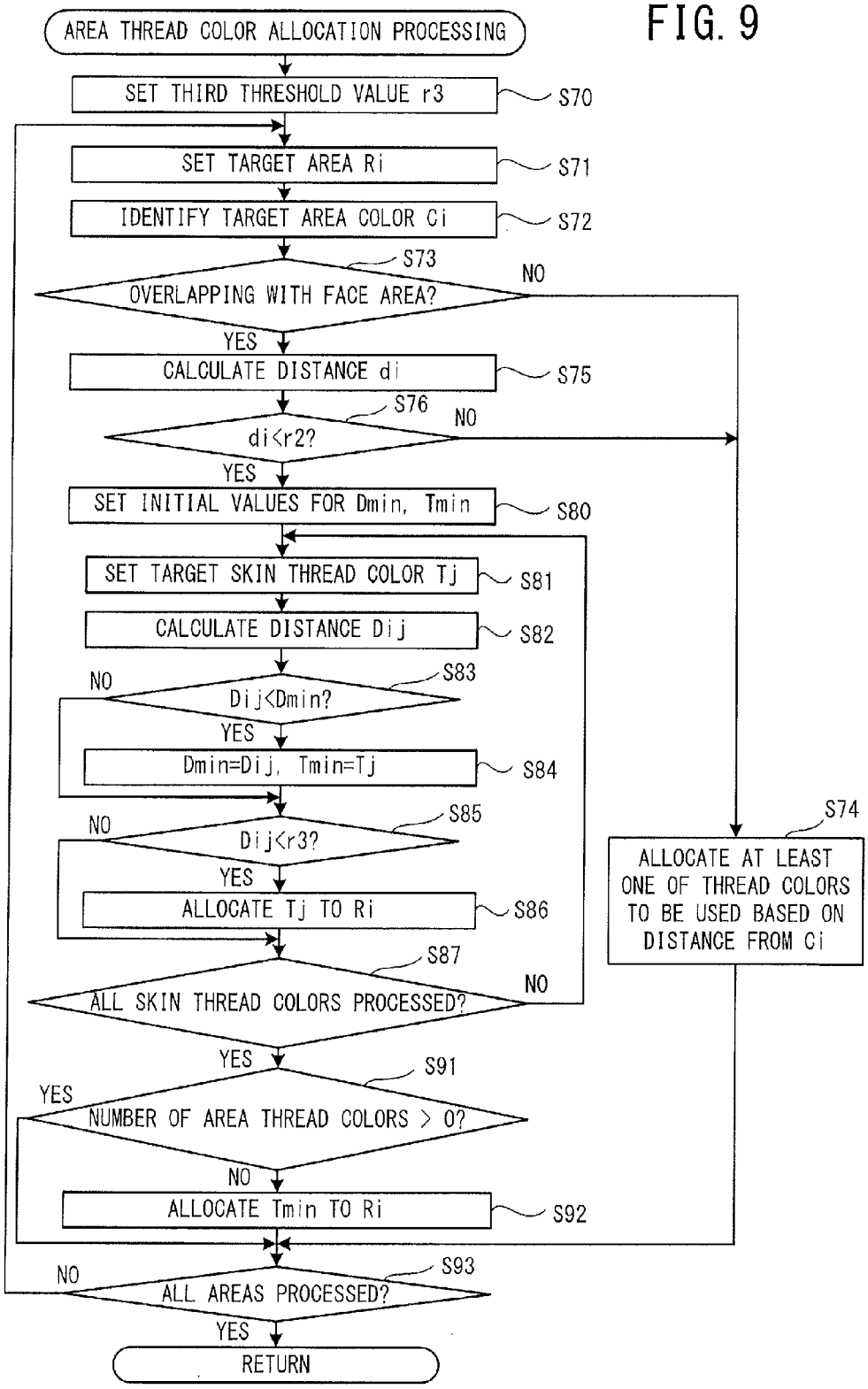
FIG. 9 is a flowchart of area thread color allocation processing.

Next, the CPU 11 performs area thread color allocation processing to allocate one or more area thread colors to each of the N areas (step S15 and FIG. 9). The area thread color is a candidate for the thread color to be used in sewing a stitch corresponding to the line segment that is associated with the area. As shown in FIG. 9, the CPU 11 first sets a third threshold value r3 (step S70). The third threshold value r3 is a threshold value of a distance in color space from the representative color, and defines a range of colors that are similar to the representative color of the area to a certain degree. The third threshold value r3 may be a value that is specified by the user or may be a value that is stored in advance in the setting value storage area 154 of the HDD 15.

The CPU 11 sets one unprocessed area, among the N areas, as a target area Ri that is a target of the processing (step S71). The CPU 11 identifies a target area color Ci, which is the representative color of the target area Ri (step S72). Based on the data of the position of the target area Ri and the data representing the position of the face area that are stored in the RAM 12, the CPU 11 determines whether or not the target area Ri at least partially overlaps with the face area (step S73).

In a case where the target area Ri at least partially overlaps with the face area (yes at step S73), the CPU 11 calculates the distance di in RGB space between the reference skin color C and the target area color Ci (step S75). In a case where the distance di is smaller than the second threshold value r2 (yes at step S76), the target area color Ci is similar to the reference skin color C to a certain degree. In this case, the target area Ri may be regarded as an area that corresponds to the skin portion in the face area. Thus, the CPU 11 performs processing to allocate to the target area Ri, from among the m skin thread colors, one or more skin thread colors that are inside a sphere centering on the target area color Ci and having a radius r3 in RGB space, as the area thread colors (step S80 to step S86).

The CPU 11 first sets initial values, which indicate "not set," to each of the value Dmin and the value Tmin and store the initial values in the RAM 12 (step S80). The value Dmin is a value that is used to identify a minimum value of respective distances in RGB space between the target area color Ci and the m skin thread colors. The value Tmin is a value that is used to identify the skin thread color for which the distance to the target area color Ci is the minimum value Dmin. The CPU 11 sets one unprocessed color from among the m skin thread colors as the target skin thread color Tj (step S81).

The CPU 11 calculates the distance Dij between the target skin thread color Tj and the target area color Ci (step S82). The CPU 11 determines whether or not the distance Dij is smaller than the value Dmin (step S83). In a case where the value Dmin is the initial value, the CPU 11 determines that the distance Dij is smaller than the value Dmin (yes at step S83). In this case, the CPU 11 updates the value Dmin with a value of the distance Dij and updates the value Tmin with a value indicating the target skin thread color Tj (step S84). Further, the CPU 11 determines whether or not the distance Dij is smaller than the third threshold value r3, that is, whether or not the target skin thread color Tj is within the sphere of the radius r3 from the target area color Ci in RGB space (step S85).

When the distance Dij is smaller than the third threshold value r3 (yes at step S85), the CPU 11 allocates the target skin thread color Tj as the area thread color to the target area Ri (step S86). The CPU 11 stores data representing the area thread color allocated to the target area Ri in the RAM 12. In a case where the distance Dij is not smaller than the third threshold value r3 (no at step S85), the CPU 11 advances to the processing at step S87 without allocating the area thread color to the target area Ri.

In a case where the processing of all of the m skin thread colors is not complete (no at step S87), the CPU 11 returns to the processing at step S81 and re-sets one unprocessed skin thread color as the target skin thread color Tj. In a case where the distance Dij between the target skin thread color Tj and the target area color Ci is smaller than the value Dmin (yes at step S83), the target skin thread color Tj is closer to the target area color Ci than the previously processed skin thread color. Therefore, the CPU 11 updates the value Dmin and the value Tmin (step S84). In a case where the distance Dij is not smaller than the value Dmin (no at step S83), the target skin thread color Tj is a color that is further from the target area color Ci than the previously processed skin thread color, or is a color that is similar to the same degree. Therefore, the CPU 11 advances directly to the processing at step S85 without updating the value Dmin and the value Tmin.

Figure 10:
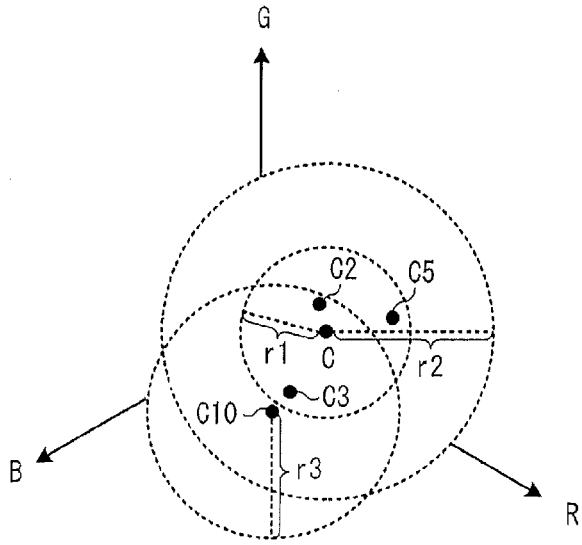
FIG. 10 is an explanatory diagram of relationships between the reference skin color, and first threshold value, the second threshold value and a third threshold value.

In the example shown in FIG. 10, among the skin thread colors C2, C3 and C5 that are within the sphere of the radius r1 centering on the reference skin color C, the skin thread colors C2 and C3 are within the sphere of the radius r3 centering on a color C10. The color C10 is inside the sphere of the radius r2 centering on the reference skin color C. Thus, when the color C10 is the target area color Ci and the skin thread color C2 is taken as the first target skin thread color Tj, the CPU 11 allocates the skin thread color C2 to the target area Ri in the first round of processing. Next, when the skin thread color C3 is taken as the target skin thread color Tj, the skin thread color C3 is also within the sphere of the radius r3 centering on the color C10, and so the CPU 11 also allocates the skin thread color C3 to the target area Ri in addition to the skin thread color C2. Next, when the skin thread color C5 is taken as the target skin thread color Tj, the skin thread color C5 is not inside the sphere of the radius r3 centering on the color C10 and so the CPU 11 does not allocate the skin thread color C5 to the target area Ri. In this manner, by the processing at step S80 to step S86, the CPU 11 allocates the skin thread colors that are close to the representative color to a certain degree to the area having the representative color that is close to the reference skin color C to a certain degree.

When the processing for all of the skin thread colors is complete (yes at step S87), the CPU 11 determines whether or not the number of area thread colors allocated to the target area Ri is larger than 0 (step S91). As in the above-described example, in a case where the one or more skin thread colors that are within the sphere of the radius r3 centering on the target area color Ci are allocated to the target area Ri (yes at step S91), the CPU 11 advances directly to the processing at step S93. In a case where the number of area thread colors is 0 (no at step S91), no skin thread color has been allocated to the target area Ri as the area thread color, even though a part of the target area Ri overlaps with the face area. Thus, the CPU 11 allocates to the target area Ri, as the area thread color, the skin thread color indicated by the value Tmin, namely, the skin thread color that is closest to the target area color Ci (step S92) and advances to the processing at step S93.

In a case where the target area Ri does not overlap with the face area at all (no at step S73), there is no need for the CPU 11 to specially allocate the skin thread color to the target area Ri. Also, in a case where the distance di is not smaller than the second threshold value r2 (no at step S76), it is not necessary to allocate the skin thread color to the target area Ri. Thus, in this type of case, the CPU 11 allocates one or more of the n thread colors to be used as the area thread colors to the target area Ri (step S74) and advances to the processing at step S93.

In the present embodiment, the area thread color allocation processing disclosed in Japanese Laid-Open Patent Publication No. 2010-273859 (US Patent Application Publication No. 2010/0305744), relevant portions of which are incorporated herein by reference, is adopted as the processing at step S74. To briefly explain, the CPU 11 performs the processing in a similar manner to that of the above-described step S80 to step S92, using the n thread colors to be used in place of the m skin thread colors, and thus allocates, as the area thread colors, all thread colors to be used that are within the sphere of the radius r3 centering on the target area color Ci. In a case where there is not even one of the thread colors to be used that is within the sphere of the radius r3 centering on the target area color Ci, the CPU 11 allocates, as the area thread color, one color from the thread colors to be used that is closest to the target area color Ci.

While the processing for all of the N areas is not complete (no at step S93), the CPU 11 repeats the processing to newly set the target area Ri and to allocate to the target area Ri, as the area thread color, one or more of the skin thread colors in a case where the target area Ri at least partially overlaps with the face area, or one or more of all of the thread colors to be used in a case where the target area Ri does not overlap with the face area at all (step S71 to step S93). When the processing to allocate the area thread color is complete for all of the areas (yes at step S93), the CPU 11 ends the area thread color allocation processing and returns to the embroidery data creation processing shown in FIG. 8.

As shown in FIG. 8, after the area thread color allocation processing (step S15), the CPU 11 performs processing to allocate one of the one or more area thread colors to each of the line segments (step S16). In the present embodiment, as the processing at step S16, processing is adopted that is disclosed as processing at step S130 of the main processing in Japanese Laid-Open Patent Publication No. 2010-273859 (US Patent Application Publication No. 2010/0305744), relevant portions of which are incorporated herein by reference. The processing is briefly explained below. Based on the line segment data pieces that have been associated with the individual areas at step S14 and the data pieces for the one or more area thread colors that have been allocated to the individual areas, the CPU 11 allocates, as a thread color to be used for sewing a stitch that corresponds to a line segment, one of the one or more area thread colors for the area with which the line segment is associated. For example, the CPU 11 may allocate, to each of the line segments, the area thread color that is closest to the color of the central pixel of the line segment.

After the thread colors to be used are determined corresponding to all of the line segments, the CPU 11 performs processing to connect the line segments (step S21), and processing to create the embroidery data (step S22) in the same manner as that of the above-described embodiment.

As described above, in the present embodiment, the CPU 11 divides the original image into N areas, each having a different representative color, and associates each of the arranged line segments with one of the N areas. Further, based on the representative color of each of the areas, the CPU 11 allocates, to each of the areas, one or more area thread colors, as candidates for the thread color to be used corresponding to the line segment associated with each of the areas. At that time, in a case where the area at least partially overlaps with the face area and the representative color of the area is within a range of the second threshold value r2 from the reference skin color C, the CPU 11 allocates, to that area, one or more of the skin thread colors. As a result, the skin thread color is allocated, as the thread color to be used, to the line segment associated with that area. In this manner, it is possible to inhibit a thread color other than the skin thread color from being used when sewing the skin portion of the human face. Therefore, according to the embroidery data creation processing of the present embodiment, it is possible to create the embroidery data by selecting the thread colors that are suitable for expressing the image that includes the human face that is supposed to be represented by the skin color.

Further, in the present embodiment, the determination is made as to whether or not the representative color is within the range of the second threshold value r2 from the reference skin color C only if the area having the representative color at least partially overlaps with the face area. Thus, the processing is faster in comparison to the above-described embodiment, in which the determination is made as to whether or not the colors of the line segments in the face area are within the range of the second threshold value r2 from the reference skin color C.

Hereinafter, embroidery data creation processing according to yet another embodiment will be explained with reference to FIG. 11 to FIG. 14. In the embroidery data creation processing explained below, only the content of the thread colors to be used determination processing (step S10) and the thread color allocation processing (step S20) is different to the embroidery data creation processing of the first embodiment (refer to FIG. 3). Thus, in the following explanation, only the content of the thread colors to be used determination processing and the thread color allocation processing according to the present embodiment will be explained.

Figure 11:
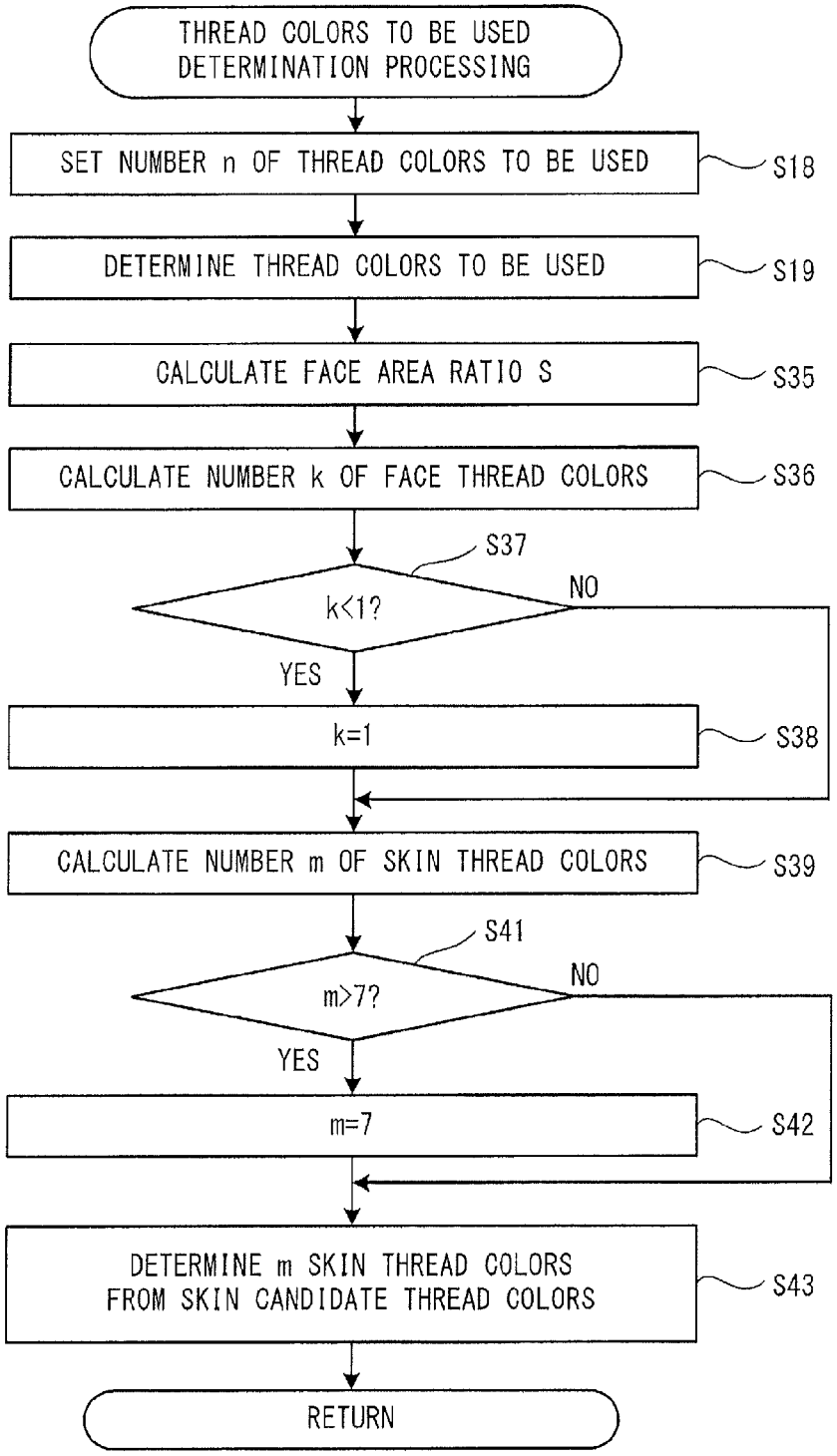
FIG. 11 is a flowchart of the thread colors to be used determination processing according to another embodiment.

As shown in FIG. 11, in the thread colors to be used determination processing of the present embodiment, the CPU 11 first sets the number n of thread colors to be used (step S18). This processing is the same as the processing at step S31 shown in FIG. 5 of the first embodiment. Next, the CPU 11 determines, from the candidate thread colors, the n thread colors to be used, using the same method as at step S44 and step S45 shown in FIG, 5 (step S19). More specifically, the CPU 11 reduces the colors of the original image to n colors using the median cut method or the like. From among all of the candidate thread colors, the CPU 11 sequentially selects, as the n colors, colors that are within a specific distance in RGB space from the n colors after color reduction and that are as far as possible from the already determined thread colors.

Further, the CPU 11 calculates the face area ratio S and determines the m skin thread colors depending on the face area ratio S (step S35 to step S43). This processing is the same as the processing performed in the thread colors to be used determination processing according to the first embodiment, and an explanation thereof is omitted here. When the m skin thread colors are determined, the CPU 11 ends the thread colors to be used determination processing.

It should be noted that, in the present embodiment, the n thread colors to be used that are determined at step S19 may not include the skin thread colors. The m skin thread colors that are determined at step S43 are colors that may be used to replace the thread colors to be used of line segments that satisfy specific conditions, in the thread color allocation processing (refer to FIG. 12) that will be explained later. All of the m skin thread colors need not necessarily be the thread colors to be used, and m is an upper limit value of the number of thread colors to be used that are replaced.

Figure 12:
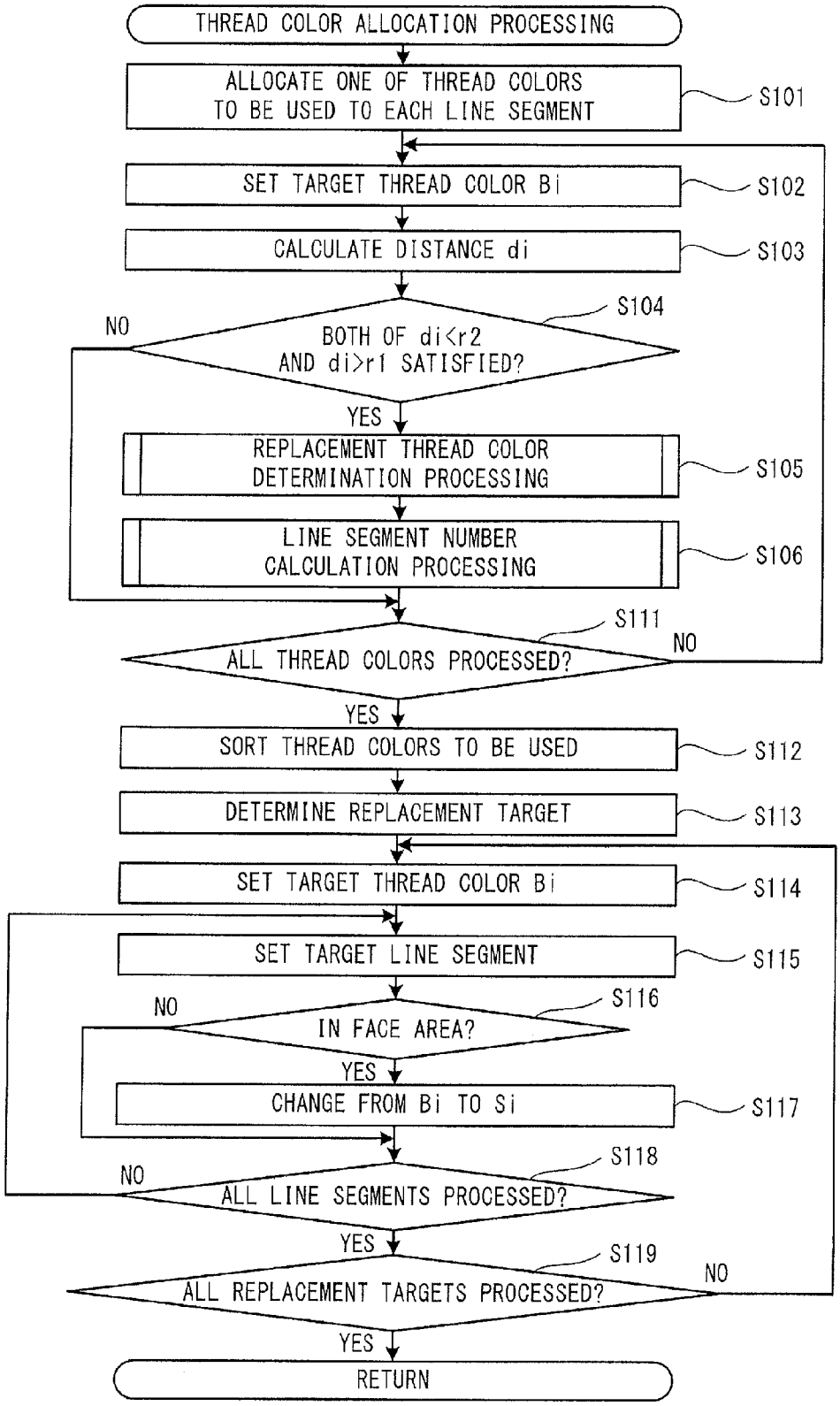
FIG. 12 is a flowchart of the thread color allocation processing according to the other embodiment.

As shown in FIG. 12, in the thread color allocation processing of the present embodiment, based on the colors of the original image, the CPU 11 first performs processing to allocate one of the n thread colors to be used to each of the line segments arranged in the area corresponding to the original image (step S101). In the present embodiment, the CPU 11 allocates the thread colors to be used based on the color of each of the line segments, after determining the color of each of the line segments using a method disclosed in Japanese Laid-Open Patent Publication No. 2001-259268 (US Patent Application Publication No. 2002/0038162), relevant portions of which are incorporated herein by reference. More specifically, as explained in relation to step S51 and step S54 (refer to FIG. 7) of the thread color allocation processing of the first embodiment, the CPU 11 determines the color of each of the line segments based on the colors of the original image and the colors of the already determined line segments, and allocates, to each of the line segments, the thread color to be used that is closest to the color of each of the line segments, among the n thread colors to be used. The CPU 11 stores data representing the allocated thread colors to be used in the RAM 12, in association with the respective line segment data pieces of the line segments.

The CPU 11 sets one color of the n thread colors to be used, as a target thread color Bi that is a processing target (step S102). The CPU 11 calculates a distance dij in RGB space between the reference skin color C and the target thread color Bi (step S103). The CPU 11 determines whether or not the distance di is smaller than the second threshold value r2 and larger than the first threshold value r1 (step S104). In a case where the distance di is smaller than the second threshold value r2 and larger than the first threshold value r1, this means that the target thread color Bi is within the sphere of the radius r2 centering on the reference skin color C shown in FIG. 4, and is also outside the sphere of the radius r1. In other words, the target thread color Bi is not inside the range that is taken as the range of the skin thread colors, but is in a range that is close to the reference skin color C to a certain degree. Therefore, the target thread color Bi may be a thread color that is allocated to the skin portion.

In a case where at least one of first and second conditions is not satisfied (no at step S104), the CPU 11 advances directly to the processing at step S111. The first condition is that the distance di is smaller than the second threshold value r2, and the second condition is that the distance di is larger than the first threshold value r1. On the other hand, in a case where both the first condition and the second condition are satisfied (yes at step S104), the CPU 11 performs replacement thread color determination processing (step S105 and FIG. 13). The replacement thread color determination processing is processing to determine the thread color with which the target thread color Bi is replaced.

Figure 13:
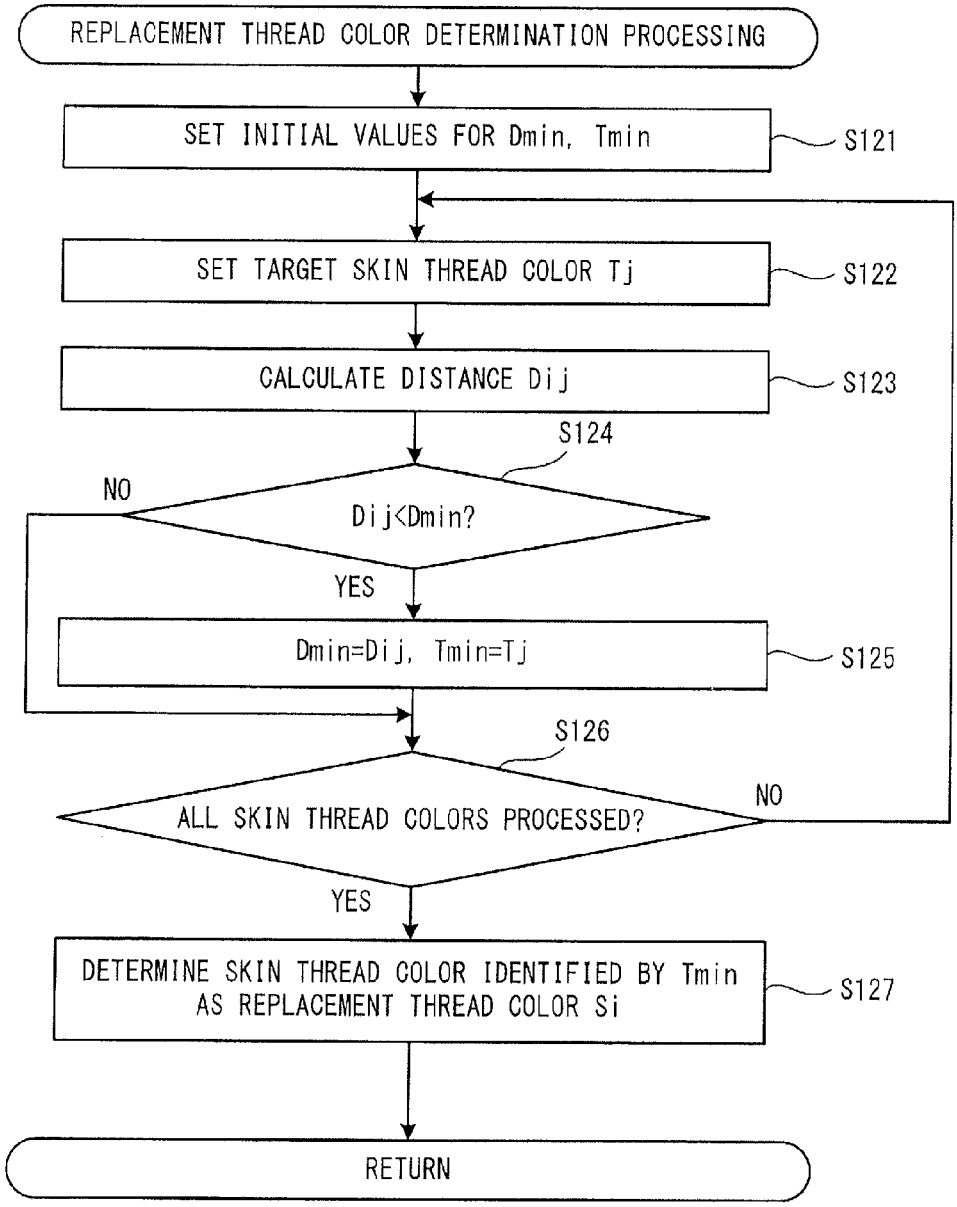
FIG. 13 is a flowchart of replacement thread color determination processing.

As shown in FIG. 13, the CPU 11 first sets initial values, which indicate "not set," to each of the value Dmin and the value Tmin and stores the initial values in the RAM 12 (step S121). The value Dmin is a value that is used to identify a minimum value of respective distances in RGB space between the target thread color Bi and the m skin thread colors. The value Tmin is a value that is used to identify the skin thread color for which the distance to the target thread color Bi is the minimum value Dmin. The CPU 11 sets one unprocessed color from among the m skin thread colors as the target skin thread color Tj (step S122).

The CPU 11 calculates the distance Dij between the target skin thread color Tj and the target thread color Bi (step S123). In a case where the value Dmin is the initial value, the CPU 11 determines that the distance Dij is smaller than the value Dmin (yes at step S124). The CPU 11 updates the value Dmin with a value of the distance Dij and updates the value Tmin with a value indicating the target skin thread color Tj (step S125). In a case where the processing of all of the m skin thread colors is not complete (no at step S126), the CPU 11 returns to the processing at step S122 and re-sets one unprocessed skin thread color as the target skin thread color Tj.

In a case where the distance Dij between the target skin thread color Tj and the target thread color Bi is smaller than the value Dmin (yes at step S124), the target skin thread color Tj is closer to the target thread color Bi than the previously processed skin thread color. Therefore, the CPU 11 updates the value Dmin and the value Tmin (step S125). In a case where the distance Dij is not smaller than the value Dmin (no at step S124), the target skin thread color Tj is a color that is further from the target thread color Bi than the previously processed skin thread color, or is a color that is similar to the same degree. Therefore, the CPU 11 advances directly to the processing at step S125.

While the processing of all the m skin thread colors is not complete (no at step S126), the CPU 11 repeats the processing from step S122 to step S126. When the processing is complete for all of the m skin thread colors (yes at step S126), the CPU 11 determines the skin thread color identified by the value Tmin as a replacement thread color Si (step S127). The replacement thread color Si is a thread color with which the target thread color Bi may be replaced. The CPU 11 stores data representing the target thread color Bi and the replacement thread color Si in the RAM 12. The CPU 11 ends the replacement thread color determination processing and returns to the thread color allocation processing shown in FIG. 12.

Figure 14:
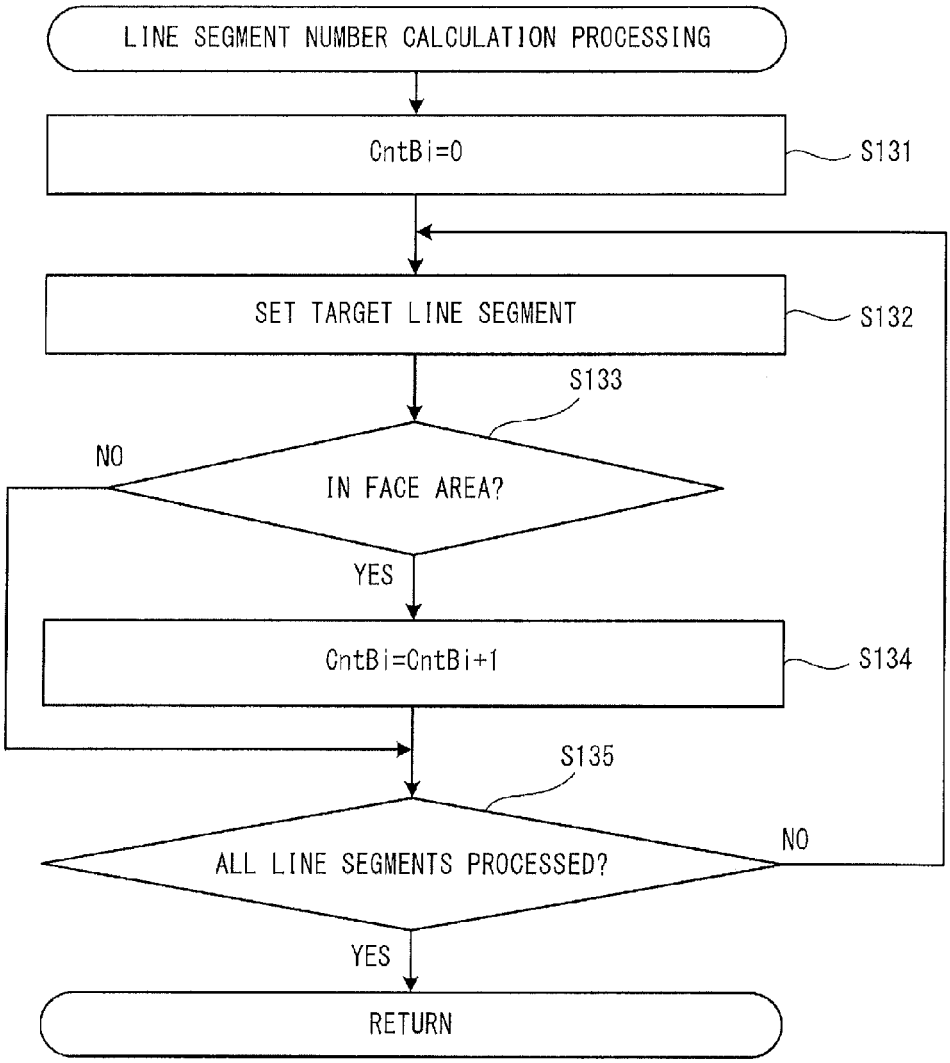
FIG. 14 is a flowchart of line segment number calculation processing.

As shown in FIG. 12, after the replacement thread color determination processing (step S105), the CPU 11 performs line segment number calculation processing (step S106 and FIG. 14). The line segment number calculation processing is processing to count the number of the line segments to which the target thread color Bi is allocated, in the face area. As shown in FIG. 14, in the line segment number calculation processing, the CPU 11 first sets a value of a variable CntBi to 0. The variable CntBi is a variable that is used to count the number of the line segments in the face area to which the target thread color Bi is allocated, (step S131). The CPU 11 sets, as a target line segment Ax, one of the line segments for which the thread color to be used that is allocated at step S101 is the target thread color Bi (step S132).

Based on whether or not the central pixel of the target line segment Ax is in the face area, the CPU 11 determines whether or not the target line segment Ax is a line segment that is in the face area (step S133). In a case where the target line segment Ax is not in the face area (no at step S133), it is not necessary to perform the count and so the CPU 11 advances directly to the processing at step S135. In a case where the target line segment Ax is in the face area (yes at step S133), the target line segment Ax may be regarded as a line segment corresponding to the skin portion. Thus, the CPU 11 adds 1 to the value of the variable CntBi (step S134) and advances to the processing at step S135.

While the processing for all of the line segments for which the thread color to be used is the target thread color Bi is not complete (no at step S135), the CPU 11 repeats the processing from step S132 to step S135, and counts the number of the line segments in the face area to which the target thread color Bi is allocated. When the processing for all the line segments is complete (yes at step S135), the CPU 11 stores data representing the target thread color Bi and the value of the variable CntBi in the RAM 12. The CPU 11 ends the line segment number calculation processing and returns to the thread color allocation processing shown in FIG. 12.

As shown in FIG. 12, after the line segment number calculation processing (step S106), the CPU 11 determines whether or not the processing is complete for all of the n thread colors to be used (step S111). While the processing for all of the thread colors to be used is not complete (no at step S111), the CPU 11 repeats the processing to determine the replacement thread color and to count the number of the line segments having that color in the face area in a case where the thread color to be used satisfies the above-described first condition and second condition (step S102 to step S111). When the processing for all of the thread colors to be used is complete (yes at step S111), the CPU 11 sorts the thread colors to be used (step S112), based on the data representing the variables CntBi stored in the line segment number calculation processing (step S106). More specifically, the CPU 11 sorts the thread colors to be used for which the replacement thread colors have been determined at step S105, in descending order from the largest value of the variable CntBi. In other words, the CPU 11 sorts the thread colors to be used in descending order from the largest number of the line segments in the face area.

Based on a position in the order after the sorting, the CPU 11 determines, from among the thread colors to be used for which the replacement colors have been determined, a target that will actually be replaced (step S113). More specifically, in a case where the number of the thread colors to be used for which the replacement colors have been determined is greater than m, the CPU 11 determines the m colors that have higher positions in the order after the sorting to be the targets of replacement. In a case where the number of the thread colors to be used for which the replacement thread colors have been determined is not greater than m, the CPU 11 determines all of the thread colors to be used for which the replacement thread colors have been determined to be the targets of replacement.

The CPU 11 sets one of the thread colors to be used that have been determined as the replacement targets, as the target thread color Bi (step S114). The CPU 11 sets, as the target line segment Ax, one of the line segments for which the thread color to be used that is allocated at step S101 is the target thread color Bi (step S115). Based on whether or not the central pixel of the target line segment Ax is in the face area, the CPU 11 determines whether or not the target line segment Ax is a line segment that is in the face area (step S116). In a case where the target line segment Ax is in the face area (yes at step S116), the CPU 11 replaces the thread color to be used corresponding to the target line segment Ax with the replacement thread color Si that is determined with respect to the target thread color Bi at step S127 (refer to FIG. 13) in the replacement thread color determination processing (step S117). More specifically, data representing the thread color to be used that is associated with the line segment data of the target line segment Ax at step S101 is changed to data representing the replacement thread color. In a case where the target line segment Ax is not in the face area (no at step S116), the CPU 11 advances directly to the processing at step S118 without replacing the thread color to be used of the target line segment Ax.

While the unprocessed line segments are remaining for which the thread color to be used is the target thread color Bi (no at step 118), the CPU 11 repeats the processing to replace the thread color to be used with the replacement thread color, in a case where the target line segment Ax is in the face area (step S115 to step S118). While the unprocessed replacement targets are remaining (no at step S119), the CPU 11 repeats the processing to replace the thread color to be used with the replacement thread color, in a case where the line segment to which the thread color to be used of each of the replacement targets is in the face area (step S114 to step s119). When the processing of all of the replacement targets is complete (yes at step S119), the CPU 11 ends the thread color allocation processing shown in FIG. 12.

In the present embodiment, the number of thread colors to be used that are initially allocated is n. Of the n thread colors to be used, however, maximum m colors are replaced with the skin thread colors. At this time, if all the skin thread colors that are taken as the replacement thread colors are originally included in the n thread colors to be used, even if the thread color to be used is replaced at step S117, the number of the thread colors to be used is finally n. However, if the skin thread colors that are taken as the replacement thread colors are not included in the n thread colors to be used, the number of thread colors to be used finally increases by the number (the upper limit m) of the skin thread colors that are replaced.

As described above, in the present embodiment, the CPU 11 first determines the thread color to be used for all of the line segments. After that, the CPU 11 counts, for each of the thread colors to be used, the number of the line segments that are in the face area and to which is allocated the thread color to be used that is not the skin thread color but is close to the skin thread color, namely, the line segments corresponding to the skin portion of the human face. Then, taking the m colors as the upper limit, starting from the largest number of counted line segments, the CPU 11 replaces the thread color to be used of the line segment that is in the face area and to which the thread color that is not the skin thread color but is close to the skin thread color is allocated, with the closest skin thread color. In this manner, when sewing the skin portion of the human face, it is possible to inhibit the thread color other than the skin thread color from being used. As a result, according to the embroidery data creation processing of the present embodiment, it is possible to create the embroidery data by selecting the thread colors that are suitable for expressing the image that includes the human face that is supposed to be represented by the skin color.

Various modifications can be applied to the above-described embodiments. For example, in the above-described embodiments, the example of the specific object is the skin portion of the human face, but the specific object may be a different specific object that is wished to be sewn using a specific thread color. For example, apart from the skin of the human face, the eyes of the human face may be taken as the specific object and blue may be the specific thread color. Examples are not limited to the human face, and leaves of a tree and green, the sky and blue etc. may be taken as the specific object and the specific thread color. In addition, for example, data pieces that represent a plurality of specific objects and reference colors that respectively correspond to the specific objects associated with each other may be stored in advance in the setting value storage area 154 of the HDD 15. In this case, at step S2 (refer to FIG. 3) of the embroidery data creating processing, the CPU 11 may read the data piece of the reference color corresponding to the specific object specified by the user using the keyboard 21, and may thus set the reference color. Alternatively, the CPU 11 may set, as the reference color, a thread color selected by the user from among the plurality of candidate thread colors.

In the thread colors to be used determination processing shown in FIG. 5, the number m of skin thread colors need not necessarily be a number that depends on the face area ratio S. For example, the user may look at the original image and specify a value that is thought to be suitable. Further, the skin thread color need not necessary be a thread color that is within the range of the first threshold value r1 from the reference skin color C, and may be a thread color that is specified by the user.

In the above-described embodiments, the example is given in which the processing is performed on the line segment or the area considered to correspond to the skin portion when the line segment is in the rectangular face area and has a color that is within the range of the second threshold value r2 from the reference skin color C, or when the area at least partially overlaps with the face area and the representative color of the area is within the range of the second threshold value r2 from the reference skin color C. However, the CPU 11 need not necessarily identify the line segment or the area corresponding to the skin portion using such methods as those in the above-described embodiments. For example, the CPU 11 may identify the line segment or the area corresponding to the skin portion based on a relative distance from eyes, a nose, a mouth, eyebrows and glasses etc. that are detected when detecting the face.

In the embodiment shown in FIG. 11 to FIG. 14, the line segment to which the thread color to be used that is the replacement target is allocated need not necessarily be the line segment in the face area and the thread colors of all the line segments arranged in the whole area corresponding to the original image may be replaced. In this case, even if the m colors are replaced by the skin thread colors, the final number of thread colors to be used does not increase above the number n of thread colors to be used that are first allocated to the line segments.

The image data may be data that represents the color of each pixel using another form (for example, hue, brightness or saturation) instead of the RGB values.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A non-transitory computer-readable medium storing computer-readable instructions that, when executed by a processor of a device, cause the device to:

acquire a plurality of pieces of thread color data, each of the plurality of pieces of thread color data representing a thread color;

acquire image data representing an image;

arrange a plurality of line segments based on the image data, each of the plurality of line segments corresponding to each of a plurality of stitches for sewing the image;

calculate a ratio of a first area occupied by a specific object with respect to the image, based on the image data;

identify one or more of pieces of first thread color data among the plurality of pieces of thread color data, based on the ratio;

identify one or more of pieces of second thread color data among the plurality of pieces of thread color data, based on the image data;

allocate, to one or more of first line segments corresponding to the first area, first specific thread color data among the one or more of pieces of first thread color data;

allocate, to one or more of second line segments corresponding to a second area, second specific thread color data among the one or more pieces of first thread color data and the one or more pieces of second thread color data, wherein the second area is an area different from the first area in the image represented by the image data;

connect the plurality of line segments based on the allocated thread color data; and create embroidery data representing the plurality of stitches based on the connected plurality of line segments.

2. The non-transitory computer-readable medium storing computer-readable instructions according to claim 1, wherein the computer-readable instructions further cause the device to set a first number representing a number of the one or more pieces of first thread color data, based on the ratio and a number of the plurality of pieces of thread color data, and wherein the identifying the one or more pieces of first thread color data comprises identifying the first number of pieces of first thread color data in response to setting the first number.

3. The non-transitory computer-readable medium storing computer-readable instructions according to claim 2, wherein the computer-readable instructions further cause the device to:

calculate the first number based on a value, wherein the value is calculated by multiplying the number of the plurality of pieces of thread color data by the ratio; and determine whether the calculated first number is greater than a threshold value, and wherein the setting the first number comprises setting the first number to an upper limit value, in response to determining that the calculated first number is greater than the threshold value.

4. The non-transitory computer-readable medium storing computer-readable instructions according to claim 1, wherein the identifying the one or more pieces of first thread color data comprises identifying, among the plurality of pieces of thread color data, the one or more pieces of first thread color data, each of the one or more pieces of first thread color data representing a thread color within a first range from a reference color in a color space, and wherein the reference color is a representative color of the specific object.

5. The non-transitory computer-readable medium storing computer-readable instructions according to claim 4, wherein the computer-readable instructions further cause the device to:

determine whether a color of a pixel corresponding to each of the one or more of the first line segments is within a second range from the reference color in the color space, based on the image data, wherein the second range is wider than the first range; and allocate the second specific thread color data among the one or more pieces of first thread color data and the one or more pieces of second thread color data to the first line segment, in response to determining that the color of the pixel is not within the second range, wherein the allocating the first specific thread color data among the one or more pieces of first thread color data to the one or more of the first line segments comprises allocating the first specific thread color data to the first line segment, in response to determining that the color of the pixel is within the second range.

6. The non-transitory computer-readable medium storing computer-readable instructions according to claim 4, wherein the computer-readable instructions further cause the device to:

divide the image data into a plurality of divided areas, wherein each of the plurality of divided areas comprises an area representative color; and associate each of the plurality of line segments with one of the plurality of divided areas, based on a position of each of the plurality of line segments in the image represented by the image data;

wherein the allocating the first specific thread color data to one or more of the first line segments comprises:

allocating, based on the area representative color, the first specific thread color data to a specific divided area among the plurality of divided areas, the specific divided area corresponding to a part of the first area and the specific divided area comprising the area representative color within a second range from the reference color in the color space, wherein the second range is wider than the first range; and allocating the first specific thread color data to one or more of the first line segments associated with the first divided area, and wherein the allocating the second specific thread color data to one or more of second line segments comprises:

allocating, based on the area representative color, the second specific thread color data to other divided area among the plurality of divided areas; and allocating the second specific color data to one or more of the second line segments associated with the other divided area.

7. The non-transitory computer-readable medium storing computer-readable instructions according to claim 6, wherein the computer-readable instructions further cause the device to:

identify the first specific thread color data among the one or more pieces of first thread color data, the first specific thread color data representing a thread color within a third range from the area representative color corresponding to the specific divided area in the color space.

8. The non-transitory computer-readable medium storing computer-readable instructions according to claim 1, wherein the computer-readable instructions further cause the device to determine whether the image data includes a human face, and wherein the identifying the one or more pieces of first thread color data comprises identifying one or more pieces of thread color data, wherein each of the one or more pieces of thread color data represents a skin color.

9. A device comprising:

a processor; and a memory configured to store computer-readable instructions that, when executed by the processor, cause the device to:

acquire a plurality of pieces of thread color data, each of the plurality of pieces of thread color data representing a thread color;

acquire image data representing an image;

arrange a plurality of line segments based on the image data, each of the line segments corresponding to each of a plurality of stitches for sewing the image;

calculate a ratio of a first area occupied by a specific object with respect to the image, based on the image data;

identify one or more pieces of first thread color data among the plurality of pieces of thread color data, based on the ratio;

identify one or more pieces of second thread color data among the plurality of pieces of thread color data, based on the image data;

allocate, to one or more of first line segments corresponding to the first area, first specific thread color data among the one or more pieces of first thread color data;

allocate, to one or more of second line segments corresponding to a second area, second specific thread color data among the one or more pieces of first thread color data and the one or more pieces of second thread color data, wherein the second area is an area different from the first area in the image represented by the image data;

connect the plurality of line segments based on the allocated thread color data; and create embroidery data representing the plurality of stitches based on the connected plurality of line segments.

10. The device according to claim 9, wherein the computer-readable instructions further cause the device to set a first number representing a number of the one or more pieces of first thread color data, based on the ratio and a number of the plurality of pieces of thread color data, and wherein the identifying the one or more pieces of first thread color data comprises identifying the first number of pieces of first thread color data in response to setting the first number.

11. The device according to claim 10, wherein the computer-readable instructions further cause the device to:

calculate the first number based on a value, wherein the value is calculated by multiplying the number of the plurality of pieces of thread color data by the ratio; and determine whether the calculated first number is greater than a threshold value, and wherein the setting the first number comprises setting the first number to an upper limit value, in response to determining that the calculated first number is greater than the threshold value.

12. The device according to claim 9, wherein the identifying the one or more pieces of first thread color data comprises identifying, among the plurality of pieces of thread color data, the one or more pieces of first thread color data, each of the one or more pieces of first thread color data representing a thread color within a first range from a reference color in a color space, wherein the reference color is a representative color of the specific object.

13. The device according to claim 12, wherein the computer-readable instructions further cause the device to:

determine whether a color of a pixel corresponding to each of the one or more of the first line segments is within a second range from the reference color in the color space, based on the image data, wherein the second range is wider than the first range; and allocate the second specific thread color data among the one or more pieces of first thread color data and the one or more pieces of second thread color data to the first line segment, in response to determining that the color of the pixel is not within the second range, wherein the allocating the first specific thread color data among the one or more pieces of first thread color data to the one or more of the first line segments comprises allocating the first specific thread color data to the first line segment, in response to determining that the color of the pixel is within the second range.

14. The device according to claim 12, wherein the computer-readable instructions further cause the device to:

divide the image into a plurality of divided areas, wherein each of the plurality of divided areas comprises an area representative color; and associate each of the plurality of line segments with one of the plurality of divided areas, based on a position of each of the plurality of line segments in the image represented by the image data;

wherein the allocating the first specific thread color data to one or more of the first line segments comprises:

allocating, based on the area representative color, the first specific thread color data to a specific divided area among the plurality of divided areas, the specific divided area corresponding to a part of the first area and the specific divided area comprising the area representative color within a second range from the reference color in the color space, wherein the second range is wider than the first range; and allocating the first specific thread color data to one or more of the first line segments associated with the first divided area, and wherein the allocating the second specific thread color data to one or more of second line segments comprises:

allocating, based on the area representative color, the second specific thread color data to other divided area among the plurality of divided areas; and allocating the second specific color data to one or more of the second line segments associated with the other divided area.

15. The device according to claim 14, wherein the computer-readable instructions further cause the device to:

identify the first specific thread color data among the one or more pieces of first thread color data, the first specific thread color data representing a thread color within a third range from the area representative color corresponding to the specific divided area in the color space.

16. The device according to claim 9, wherein the computer-readable instructions further cause the device to determine whether the image includes a human face, and wherein the identifying of the one or more pieces of first thread color data comprises identifying one or more pieces of thread color data, wherein each of the one or more pieces of thread color data represents a skin color.

17. A non-transitory computer-readable medium storing computer-readable instructions that, when executed by a processor of a device, cause the device to:

acquire a plurality of pieces of thread color data, each of the plurality of pieces of thread color data representing a thread color;

acquire image data representing an image;

arrange a plurality of line segments based on the image data, each of the plurality of line segments corresponding to each of a plurality of stitches for sewing the image;

calculate a ratio of a first area occupied by a specific object with respect to the image, based on the image data;

identify one or more pieces of first thread color data among the plurality of pieces of thread color data, based on the ratio, each of the one or more pieces of first thread color data representing a thread color within a first range from a reference color in a color space, and wherein the reference color is a representative color of the specific object;

identify one or more pieces of second thread color data among the plurality of pieces of thread color data, based on the image data;

allocate specific thread color data among the one or more pieces of second thread color data to each of the plurality of line segments, based on the image data;

determine whether the one or more pieces of second thread color data include one or more pieces of third thread color data, each of the one or more pieces of third thread color data representing a thread color that is not within the first range and is within a second range from the reference color in the color space, wherein the second range is wider than the first range;

replace each of the one or more pieces of third thread color data with one of the one or more pieces of first thread color data, in response to determining that the one or more pieces of second thread color data include the one or more pieces of third thread color data;

connect the plurality of line segments based on the allocated thread color data; and create embroidery data representing the plurality of stitches based on the connected plurality of line segments.

18. The non-transitory computer-readable medium storing computer-readable instructions according to claim 17, wherein the computer-readable instructions further cause the device to set an upper limit value for a first number, based on a second number and the ratio, wherein the first number represents a number of the one or more pieces of first thread color data, and wherein the second number represents a number of the one or more pieces of second thread color data, and wherein the replacing of each of the one or more pieces of third thread color data with one of the one or more of pieces of first thread color data comprises:

counting a number of one or more of the line segments to which the one or more pieces of third thread color data are allocated;

setting priority order of the one or more pieces of third thread color data, in descending order of the counted number of the one or more of the line segments; and repeatedly replacing the one or more pieces of third thread color data allocated to the one or more of the line segments to one of the one or more pieces of first thread color data in accordance with the priority order, when a number of replaced pieces of third thread color data is less than the upper limit value.

19. The non-transitory computer-readable medium storing computer-readable instructions according to claim 17, wherein the computer-readable instructions further cause the device to determine whether the image data includes a human face, and wherein the identifying the one or more pieces of first thread color data comprises identifying one or more pieces of thread color data, wherein each of the one or more pieces of thread color data represents a skin color.

* * * * *